US011619907B2

(12) United States Patent
Hiyama et al.

(10) Patent No.: US 11,619,907 B2
(45) Date of Patent: Apr. 4, 2023

(54) PROCESS CARTRIDGE

(71) Applicant: CANON KABUSHIKI KAISHA, Tokyo (JP)

(72) Inventors: Fumiyuki Hiyama, Shizuoka (JP); Shuhei Iwasaki, Kanagawa (JP); Hiroyuki Watanabe, Shizuoka (JP); Nobuhiro Nakamura, Shizuoka (JP); Tomohito Ishida, Shizuoka (JP); Shuntaro Watanabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/689,771

(22) Filed: Mar. 8, 2022

(65) Prior Publication Data

US 2022/0291627 A1 Sep. 15, 2022

(30) Foreign Application Priority Data

Mar. 10, 2021 (JP) ..... JP2021-038766

(51) Int. Cl.
*G03G 15/00* (2006.01)
*G03G 21/18* (2006.01)
*G03G 21/00* (2006.01)

(52) U.S. Cl.
CPC ..... *G03G 21/1814* (2013.01); *G03G 21/0011* (2013.01); *G03G 2221/183* (2013.01)

(58) Field of Classification Search
CPC ..... G03G 15/751; G03G 21/0005; G03G 21/0011; G03G 21/1814; G03G 2215/00962; G03G 2221/0026; G03G 2221/1606; G03G 2221/183
See application file for complete search history.

(56) References Cited

U.S. PATENT DOCUMENTS

| | | | | |
|---|---|---|---|---|
| 4,804,607 | A | 2/1989 | Atsumi | |
| 10,747,130 | B2 * | 8/2020 | Okuda | G03G 5/0525 |
| 2015/0241799 | A1 * | 8/2015 | Takahashi | G03G 5/147 399/111 |

FOREIGN PATENT DOCUMENTS

| | | | |
|---|---|---|---|
| EP | 2019339 | A1 | 1/2009 |
| EP | 3901702 | A1 | 10/2021 |
| EP | 3901703 | A1 | 10/2021 |
| JP | 2010026240 | A | 2/2010 |
| JP | 2010250355 | A | 11/2010 |
| JP | 2011-002788 | A | 1/2011 |
| JP | 2011-158491 | A | 8/2011 |
| JP | 2015161786 | A | 9/2015 |

* cited by examiner

*Primary Examiner* — Hoang X Ngo
(74) *Attorney, Agent, or Firm* — Canon U.S.A., Inc., IP Division

(57) ABSTRACT

A process cartridge including: an electrophotographic photosensitive member having a drum shape; a developing unit for developing an electrostatic latent image on the surface of the electrophotographic photosensitive member with toner; and a cleaning blade for removing the toner on the surface of the electrophotographic photosensitive member, the cleaning blade being in contact with the electrophotographic photosensitive member, wherein the electrophotographic photosensitive member comprises wrinkles on the surface of the electrophotographic photosensitive member, and wherein the toner has a fluidity torque E of 320 mJ or more.

7 Claims, 6 Drawing Sheets

PROCESS CARTRIDGE

BACKGROUND OF THE INVENTION

Field of the Invention

The present disclosure relates to a process cartridge to be used in an electrophotographic apparatus.

Description of the Related Art

An electrophotographic photosensitive member to be used in an electrophotographic apparatus is generally a drum-shaped electrophotographic photosensitive member (hereinafter also described as "electrophotographic photosensitive drum," "photosensitive drum," or simply "electrophotographic photosensitive member"). In the electrophotographic apparatus, various electrical external forces and mechanical external forces are applied to the surface (identical in meaning to an outer surface, the same holds true for the following) of the electrophotographic photosensitive member in the repeated steps of charging, exposure, development, transfer, and cleaning. Of those, a frictional force occurring between the surface of the electrophotographic photosensitive member and a cleaning blade in the cleaning is large, and affects the distortion of an image due to the abrasion of the surface of the electrophotographic photosensitive member or a reduction in cleaning power.

To alleviate the abrasion of the surface of the electrophotographic photosensitive member, the improvement of a material for the surface layer thereof has been advanced, and an improvement technology including improving the abrasion resistance thereof through use of a material excellent in abrasion resistance, such as a curable resin, in the surface layer has heretofore been investigated.

The electrophotographic photosensitive member is generally used in an electrophotographic image forming process including a charging step, an exposing step, a developing step, a transferring step, and a cleaning step. Of those, the cleaning step of removing residual toner on the electrophotographic photosensitive member after the transferring step is a step important in obtaining a clear image. A method for the cleaning is generally a method including bringing a rubbery cleaning blade into pressure contact with the electrophotographic photosensitive member to scrape off the toner.

Meanwhile, to improve the abrasion resistance, the following improvement has been performed. Unevenness is formed on the surface of the electrophotographic photosensitive member to reduce the area of contact between the surface and the cleaning blade, thereby reducing the frictional force. When the frictional force is reduced, the abrasion of the surface of the electrophotographic photosensitive member is suppressed. In addition, the contact torque between the surface of the electrophotographic photosensitive member and the cleaning blade can be reduced.

In Japanese Patent Application Laid-Open No. 2010-26240, there is a disclosure of an electrophotographic photosensitive member having a specific groove shape in its surface for the purpose of improving a cleaning property.

In Japanese Patent Application Laid-Open No. 2010-250355, there is a disclosure of a toner image-bearing member having a specific groove shape in its outer peripheral surface for the purpose of achieving both of high cleaning performance and the suppression of the entanglement of a cleaning blade.

In Japanese Patent Application Laid-Open No. 2015-161786, there is a disclosure that when the surface of an electrophotographic photosensitive member is subjected to the processing of transferring the uneven shape of a mold member, an electrophotographic photosensitive member having a surface whose uneven shape has high stability even under a high-temperature environment is obtained.

A recent electrophotographic apparatus has been required to achieve a further reduction in torque and to be free from causing a cleaning failure. In a cleaning step, a deposited layer of small particles called a blocking layer, the layer including, for example, the additive of toner, is formed on the surface of each of the cleaning blade and electrophotographic photosensitive member of the apparatus. The maintenance of the blocking layer is important in the cleaning. The cleaning failure refers to a phenomenon in which the blocking layer is broken by a certain factor to cause the toner or its external additive to escape from the cleaning blade. When the cleaning failure occurs, a streak-like image failure occurs on an image, or the fine toner or external additive that has escaped is present on the surface of the electrophotographic photosensitive member, though not appearing on the image, to adhere to a charging roller, thereby causing a disadvantage, such as a charging failure. Although the toner can be suppressed from escaping by strengthening the abutting pressure of the cleaning blade, the torque increases.

In each of the technologies disclosed in Japanese Patent Application Laid-Open No. 2010-26240 and Japanese Patent Application Laid-Open No. 2010-250355, a reduction in torque by a reduction in frictional force between the electrophotographic photosensitive member and the cleaning blade is observed. However, a groove parallel to a processing direction is processed, and hence the toner or its additive has escaped to cause a cleaning failure in some cases.

SUMMARY OF THE INVENTION

Accordingly, an aspect of the present disclosure is to provide a process cartridge that achieves both of a reduction in torque and an improvement in cleaning property.

The above-mentioned aspect is achieved by the present disclosure described below. That is, a process cartridge according to the present disclosure is a process cartridge including: an electrophotographic photosensitive member having a drum shape; a developing unit for developing an electrostatic latent image on a surface of the electrophotographic photosensitive member with toner; and a cleaning blade for removing the toner on the surface of the electrophotographic photosensitive member, the cleaning blade being in contact with the electrophotographic photosensitive member, wherein the electrophotographic photosensitive member comprises wrinkles on the surface of the electrophotographic photosensitive member, and wherein the toner has a fluidity torque E of 320 mJ or more.

Further features of the present disclosure will become apparent from the following description of exemplary embodiments with reference to the attached drawings.

DESCRIPTION OF THE EMBODIMENTS

Figure 1A:
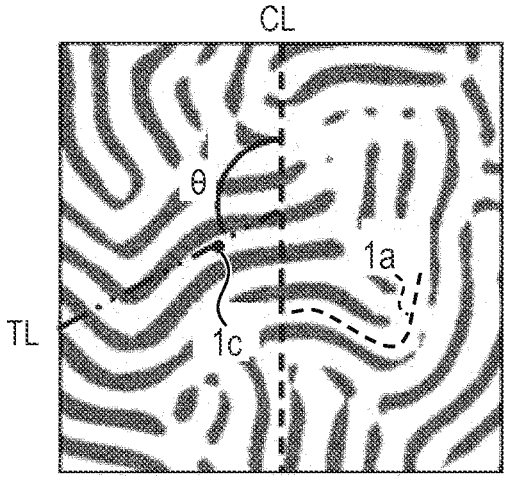
FIG. 1A is a top view of the surface of an electrophotographic photosensitive member for illustrating an example of the uneven shapes of the wrinkles of the electrophotographic photosensitive member.

Preferred embodiments of the present disclosure will now be described in detail in accordance with the accompanying drawings.

The present disclosure is described in detail below by way of a preferred embodiment.

In the related art including arranging a groove shape in the surface of an electrophotographic photosensitive member having a drum shape, a configuration in which the direction of the groove shape is parallel to the rotation direction of the electrophotographic photosensitive member having a drum shape has been adopted. Accordingly, it has been found that particularly when the abutting pressure of a cleaning blade is low, residual toner on the electrophotographic photosensitive member escapes from the abutting portion of the cleaning blade through the groove shape portion to cause a streak-like image defect or the contamination of a charging roller.

In view of the foregoing, the inventors of the present disclosure have made extensive investigations, and as a result, have found that the above-mentioned disadvantages can be solved by a process cartridge having the following configuration.

Specifically, a process cartridge according to the present disclosure is a process cartridge including: an electrophotographic photosensitive member including a support and a photosensitive layer; a developing unit for developing an electrostatic latent image on the surface of the electrophotographic photosensitive member with toner; and a cleaning blade for removing the toner on the surface of the electrophotographic photosensitive member, the cleaning blade being in contact with the electrophotographic photosensitive member, the process cartridge being characterized in that the electrophotographic photosensitive member comprises wrinkles on the surface of the electrophotographic photosensitive member, and that the toner has a fluidity torque E of 320 mJ or more.

Herein, the fact that the electrophotographic photosensitive member has wrinkles over the entirety of the surface may be recognized, for example, as described below. The wrinkles in the present invention mean unevenness whose pattern is a pattern in which a plurality of mountain range-like convex portions (hereinafter, convex portion(s)) are arranged at intervals.

In the surface of the electrophotographic photosensitive member, observation regions including, as their respective central points, 76 points of intersection of 19 line segments dividing the electrophotographic photosensitive member into 20 equal parts in its shaft direction and 4 line segments dividing the photosensitive member into 4 equal parts in its peripheral direction are placed. Each observation region is a square region 50 μm on a side, and the orientation of each observation region is set to the orientation in which one side of a square for forming the observation region is parallel to the peripheral direction of the electrophotographic photosensitive member. At this time, the following is valid for each of the 76 observation regions.

A first reference line passing the central point of any one of the observation regions and parallel to the peripheral direction of the electrophotographic photosensitive member is represented by L1. In addition, 1,799 reference lines obtained by rotating the first reference line L1 about the central point every 0.1° are represented by L2 to L1799, respectively. At this time, each of the reference lines L1 to L1799 intersects the convex portions of the wrinkles at a plurality of sites, and at least two selected from the plurality of sites have intersection angles different from each other.

<Configuration of Electrophotographic Photosensitive Member>

The electrophotographic photosensitive member of the process cartridge according to the present disclosure is an electrophotographic photosensitive member having a drum shape, and is characterized in that the surface of the electrophotographic photosensitive member has the mountain range-like wrinkles.

FIG. 1A is a top view for illustrating an example of a square observation region 50.0 μm on a side placed at a randomly-selected position on the surface of the electrophotographic photosensitive member. As illustrated in FIG. 1A, the mountain range-like wrinkles in the present disclosure are stripe-shaped uneven shapes that can be observed when the surface of the electrophotographic photosensitive member is viewed from above. The stripe shapes are not distributed in a single direction, but include, for example, a curve portion, a broken portion, and a branched portion.

In addition, the ridge line of the convex portions forming each of the wrinkles in the present disclosure refers to a straight line or a curve obtained by connecting the apices of the convex portions of the stripe-shaped uneven shape when the surface of the electrophotographic photosensitive member is observed from above as represented by reference symbol 1*a* of FIG. 1A.

Figure 1B:
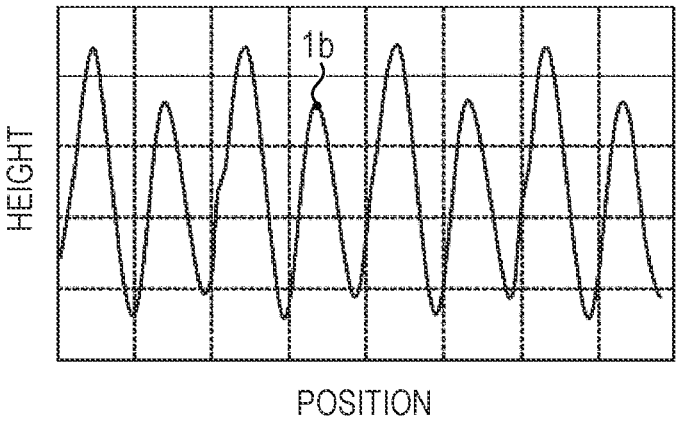
FIG. 1B is a graph for showing height information obtained from surface observation in the surface of the electrophotographic photosensitive member, the graph being for showing an example of the uneven shapes of the wrinkles of the electrophotographic photosensitive member.

Although a method of obtaining the ridge line by identifying the convex portions through the observation of the upper surface of the electrophotographic photosensitive member is not particularly limited, the convex portions may be identified by, for example, subjecting height information measured with a confocal laser microscope to image analysis. FIG. 1B is an example of a sectional profile of the uneven shape obtained from FIG. 1A. The ridge line of the wrinkle as represented by reference symbol 1*a* of FIG. 1A can be obtained by identifying the apices of convex shapes each represented by reference symbol 1*b* of FIG. 1B.

In addition, in the present invention, the ridgelines of the wrinkles have a plurality of curvatures in the ridgelines. The curvature is the amount representing a degree of bending of a curved line, and when a neighborhood of an arbitrary point on the curved line is approximated by a circle, a curvature $\chi$ is obtained as a reciprocal of a radius R of the circle as shown in Equation (I), $$\chi(s) = \frac{1}{R(s)} = \left|\frac{d^2r}{ds^2}\right| \tag{I}$$

where s represents a length of a portion corresponding to a circular arc of the curved line, and r is a position vector of the arbitrary point on the curved line.

Figure 5:
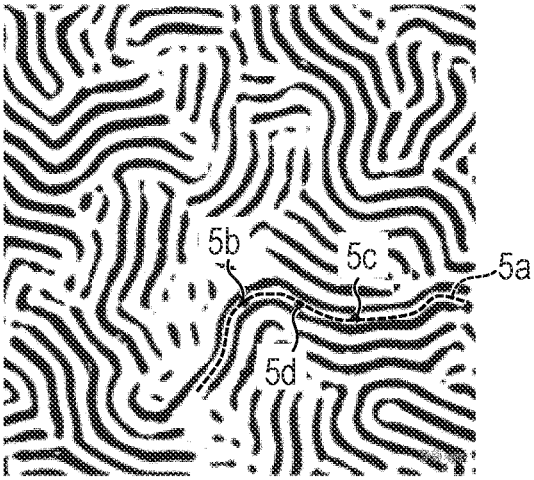
FIG. 5 is a top view illustrating an example of a concave and convex shape of a wrinkle formed on an outer surface of an electrophotographic photosensitive drum according to the present invention.

For example, at the point shown as 5*b* of FIG. 5, the curvature is large due to a large degree of bending of a ridgeline 5*a* of the wrinkle, and at the point shown as 5*c* of FIG. 5, the curvature is small due to a small degree of bending of the ridgeline 5*a* of the wrinkle.

It is preferable that the ridgeline of the wrinkle has a plurality of inflection points in the square observation region with one side of 50 μm. The inflection point refers to a point where a curving direction of the curved line is changed as illustrated in 5*d* of FIG. 5, and the curvature is zero at the inflection point.

A detailed action mechanism by which the present invention exerts its effects is presumed as follows. First, it is presumed that the wrinkles have a predetermined number or more of convex portions in a certain range, such that a contact area when the cleaning blade abuts against the electrophotographic photosensitive drum is reduced and the frictional force is thus reduced. Further, it is presumed that since the ridgelines of the convex portions of the wrinkles are directed in various directions, the toner passing through the concave portions is prevented from being slipping through when the electrophotographic photosensitive drum is rotated.

It is preferable that the electrophotographic photosensitive drum according to the present invention satisfies the following conditions.

That is, when a two-dimensional power spectrum F(r,θ) with a frequency component as r and an angle component as θ is obtained by performing frequency analysis of the height information of the wrinkles in the observation region, a one-dimensional radial direction distribution function p(r) obtained by integrating the two-dimensional power spectrum F(r,θ) in a θ direction has at least one maximum value, and when an angular distribution q(θ) is calculated from the two-dimensional power spectrum F(r,θ) at a frequency rp at which the one-dimensional radial direction distribution function p(r) has the maximum value, a variation in power values in the entire θ range is 10% or less.

As a result of studies conducted by the present inventors, it was found that in a case where the outer surface of the electrophotographic photosensitive drum has wrinkles and concave and convex shapes of the wrinkles have a predetermined periodicity as illustrated in FIGS. 5 and 1B, the effects of the present invention can be highly obtained.

As a method for obtaining the periodicity of the concave and convex shapes of the wrinkles is not particularly limited, but it is possible to use a method of acquiring height information by observing the outer surface of the electrophotographic photosensitive drum and then analyzing the obtained results by using two-dimensional Fourier transform.

Specifically, in a case where the height information of the wrinkles is obtained with the number of data $N_1 \times N_2$, when a height at an arbitrary point (n, m) in the in-plane is $h_{n,m}$, a two-dimensional power spectrum P(k,l) obtained by discrete Fourier transform is expressed by the following Equation (II).

$$P_{k,l} = \frac{1}{N_1 \cdot N_2} |f_{k,l}|^2 \tag{II}$$

Here, $f_{k,l}$ is expressed by the following Equation (III), $$f_{k,l} = \sum_{n=0}^{N_1-1} \sum_{m=0}^{N_2-1} h_{n,m} e^{-ikn} e^{-ilm} \tag{III}$$

where k and l represent a frequency in a horizontal direction and a frequency in a vertical direction, respectively.

Further, a spectrum obtained by converting the two-dimensional power spectrum P(k,l) obtained by Equation (II) from an orthogonal coordinate system (k,l) into a polar coordinate system (r,θ) is represented by the two-dimensional power spectrum F(r,θ). Here, r and θ satisfy the following Equation (IV) and Equation (V), respectively.

$$r = \sqrt{k^2 + l^2} \tag{IV}$$

$$\theta' = \mathrm{Tan}^{-1}(l/k) \tag{V}$$

In the present invention, the height information obtained by measuring the square observation region with one side of 50 μm at a regular interval of 0.25 μm or less in each of two directions parallel to each side of the square is used for the analysis.

Figure 6A:
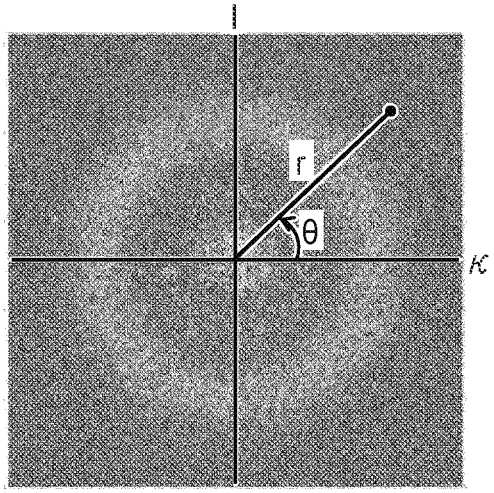
FIG. 6A is a view illustrating a two-dimensional power spectrum F(r,θ) obtained by analyzing a frequency of the wrinkles formed on the outer surface of the electrophotographic photosensitive drum according to the present invention.
Figure 6B:
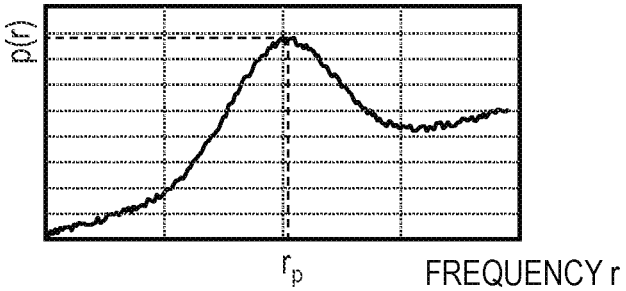
FIG. 6B is a view illustrating a one-dimensional radial direction distribution function obtained by integrating, in a θ direction, the two-dimensional power spectrum F(r,θ) obtained by analyzing the frequency of the wrinkles formed on the outer surface of the electrophotographic photosensitive drum according to the present invention.
Figure 6C:
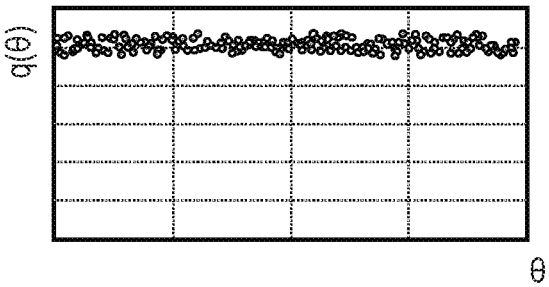
FIG. 6C is a view illustrating a variation in power values in the entire θ range when an angular distribution q(θ) is calculated from the two-dimensional power spectrum F(r,θ) at a frequency rp at which the one-dimensional radial direction distribution function p(r) has a maximum value, the one-dimensional radial direction distribution function p(r) being obtained by integrating, in the θ direction, the two-dimensional power spectrum F(r,θ) obtained by performing frequency analysis of the wrinkles formed on the outer surface of the electrophotographic photosensitive drum according to the present invention.

FIGS. 6A to 6C are views illustrating an example of the result obtained by numerical analysis of the electrophotographic photosensitive drum according to the present invention. FIG. 6A is a view illustrating the two-dimensional power spectrum F(r,θ) obtained by analyzing the frequency of the wrinkles formed on the outer surface of the electrophotographic photosensitive drum. In addition, FIG. 6B is a view illustrating the one-dimensional radial direction distribution function obtained by integrating the obtained two-dimensional power spectrum F(r,θ) in the θ direction. In addition, FIG. 6C is a view illustrating the variation in power values in the entire θ range when the angular distribution q(θ) is calculated from the two-dimensional power spectrum F(r,θ) at the frequency rp at which the one-dimensional radial direction distribution function p(r) has the maximum value.

As illustrated in FIG. 6B, it is preferable that in the electrophotographic photosensitive drum according to the present invention, the radial direction distribution function p(r) obtained by making the two-dimensional power spectrum F(r,θ) one-dimensional in the radial direction has at least one maximum value. This means that the concave and convex shapes of the wrinkles formed on the outer surface of the electrophotographic photosensitive drum are distributed at regular intervals.

In addition, as illustrated in FIG. 6C, when the angular distribution q(θ) of F(rp,θ) is calculated at the frequency rp at which p(r) is maximized, the variation in power values in the entire θ range is preferably within a predetermined range, and specifically, it is preferably 10% or less. This means that the concave and convex shapes of the wrinkles formed on the outer surface of the electrophotographic photosensitive drum are evenly distributed with the periodicity in an arbitrary direction in the in-plane of the electrophotographic photosensitive drum.

In addition, a difference Δ between an average value hm and an average value $h_{ave}$ of heights of the wrinkles in the observation region is preferably in a range of 0.5 μm to 2.0 μm, in which the average value hm is a value obtained by arbitrarily selecting five points of apexes of the convex portions of the wrinkles in the observation region and averaging heights of the apexes of the convex portions of the wrinkles at the selected five points. Here, the selected arbitrary five points does not refer to specific five points. That is, it means that the same results as described above are obtained even in a case where any five points are selected.

Further, the frequency rp at which the radial direction distribution function p(r) has the maximum value is preferably in a range of 0.05 $\mu m^{-1}$ to 1.00 $\mu m^{-1}$.

When a square observation region 50.0 μm on a side is placed at a randomly-selected position on the surface of the electrophotographic photosensitive member, and an angle formed by the tangential line of each of the ridge lines of the convex portions forming the wrinkles and a line parallel to the peripheral direction of the electrophotographic photosensitive member is represented by θ, the observation region preferably includes one or more ridge line portions of the wrinkles in each of which the θ falls within the range between 45° and 135°. The θ is described with reference to an example illustrated in FIG. 1A. In this case, the θ is, for example, an angle formed by a tangential line TL at a point 1*c* on the ridge line of the convex portions forming the wrinkle and a line CL parallel to the peripheral direction of the electrophotographic photosensitive member.

In addition, when observation points are placed on the ridge lines of the convex portions forming the wrinkles in the observation region at intervals of 5.0 μm, the observation points at each of which the θ falls within the range between 45° and 135° more preferably account for more than a half of the observation points present in the observation region.

In the present disclosure, when a sectional profile is obtained for the wrinkles in the peripheral direction of the electrophotographic photosensitive member, the sectional profile is preferably gentle. The term "gentle" as used herein means that the radius of curvature of a curve representing the sectional profile of the wrinkles is 5 μm or more.

In addition, in the present disclosure, the uneven shapes present on the surface of the electrophotographic photosensitive member preferably satisfy the following conditions.

When an angle formed by the tangential line of each of the ridge lines of the convex portions forming the wrinkles and a line parallel to the peripheral direction of the electrophotographic photosensitive member is represented by θ, the average Lave of distances between the ridge lines of the convex portions adjacent to each other, the convex portions each having a ridge line portion in which the θ falls within the range between 45° and 135°, is from 1.0 to 20.0 μm, and the average have of the heights of the convex portions having the ridge line portions is from 0.5 to 3.0 μm.

Herein, the average Lave of the distances may be determined as described below.

A square observation region 50.0 μm on a side is placed at each of the specific 76 sites on the surface of the electrophotographic photosensitive member, and the following measurement is performed for each of the observation regions.

First, 5 sites are arbitrarily selected from the ridge line of a wrinkle component present in the observation region, the component having a tangential angle within the range between 45° and 135°.

Next, the shortest distance from each of the selected 5 sites to the ridge line of an adjacent wrinkle component having a tangential angle within the range between 45° and 135° (the closer one of two wrinkle components present on both the sides of the site) is measured.

An arithmetic average is determined for measured values at the 5 sites obtained in each of the 76 observation regions, that is, a total of 76×5=380 values, and the determined value is defined as the Lave.

When a "wrinkle component that does not have a tangential angle within the range between 45° and 135°" is present between the two "wrinkle components each having a tangential angle within the range between 45° and 135°," the two "wrinkle components each having a tangential angle within the range between 45° and 135°" are regarded as not being adjacent to each other, and are hence excluded from objects of distance measurement. When a point on such wrinkle component is included in the arbitrarily selected 5 sites, selection is performed again.

In addition, the average have of the heights may be determined by: measuring heights for the same sites as the sites selected for the determination of the average Lave of the distances; and determining the arithmetic average of the resultant measured values. In the height measurement, heights from valley bottoms closest from a point on a ridge line whose height is to be determined (two valley bottoms present on both the sides of the ridge line) are measured, and the two values obtained with reference to the valley bottoms on both the sides of the ridge line are averaged.

<Configuration of Toner>

The toner is characterized by satisfying the following relational formula (1).

$$320\ (\text{mJ}) \leq E \qquad (1)$$

The E in the formula (1) represents the total sum of rotation torque and a vertical load obtained when, in a powder fluidity analyzer, a propeller-type blade is caused to vertically enter a toner powder layer having applied thereto a load of 3 kPa in a container while its outermost edge portion is rotated at a peripheral speed of 10 mm/s, measurement is started from a position distant from the bottom surface of the powder layer by 80 mm, and the blade is caused to enter up to a position distant from the bottom surface by 20 mm. In other words, an increase in value of the E means a reduction in fluidity of the toner.

[Method of Measuring E (mJ)]

The E (mJ) in the present disclosure is measured with a "powder fluidity analyzer POWDER RHEOMETER FT4 (manufactured by Freeman Technology Ltd., hereinafter sometimes abbreviated as "FT4")."

Specifically, the measurement is performed by the following operations.

Figure 3:
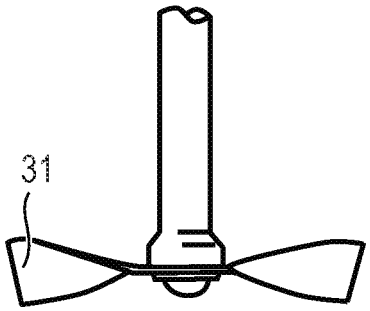
FIG. 3 is a view for illustrating the appearance of the propeller-type blade of a powder fluidity analyzer.

In all the operations, a 23.5-millimeter diameter blade 31 (material: SUS, hereinafter sometimes abbreviated as "blade") dedicated for the FT4, which is illustrated in FIG. 3, is used as the propeller-type blade. A cylindrical split container (model number: C4031, material: glass, diameter: 25 mm, hereinafter sometimes abbreviated as "container") dedicated for the FT4 is used as a measurement container.

(1) Compression Operation

A pressure of 3 kPa is applied to the toner powder layer to compress the layer.

Specifically, the FT4 is mounted with a piston for a compression test (having a diameter of 24 mm and a meshed lower portion) instead of the propeller-type blade 31. 7.0 Grams of the toner is loaded into the container, and the piston is lowered at 0.1 mm/s to compress the toner. When a load to the piston reaches 3 kPa, the piston is stopped from being lowered and is held as it is for 60 seconds to form a compressed powder layer. The operation is repeated three times to form the compressed powder layer. Finally, the compressed powder layer is leveled off with the split portion of the container dedicated for the FT4 described above so that the toner of the upper portion of the compressed powder layer may be removed.

(2) Measurement Operation

The propeller-type blade 31 is rotated counterclockwise with respect to the surface of the powder layer (direction into which the powder layer is squeezed by the rotation of the blade 31) so that the peripheral speed of the outermost edge portion of the blade 31 may be 10 mm/sec. The blade 31 is caused to enter in a vertical direction from the surface of the powder layer up to the position distant from the bottom surface of the toner powder layer by 80 mm at such an entry speed that a formed angle becomes 5°. After that, the blade 31 is rotated counterclockwise with respect to the surface of the powder layer so that the peripheral speed of the outermost edge portion may be 10 mm/s, and the blade is caused to enter in the vertical direction of the powder layer up to the position distant from the bottom surface of the powder layer by 20 mm at such an entry speed that the formed angle becomes 5°. Further, the blade 31 is pulled out by being moved up to a position distant from the bottom surface of the powder layer by 100 mm at such a speed that the formed angle becomes 2°.

Herein, the formed angle related to the entry speed refers to an angle formed by the spiral trajectory of the outermost edge portion of the propeller observed from the side when the blade is vertically moved while being rotated and the toner powder layer.

When the pulling is completed, the toner adhering to the blade 31 is shaken off by alternately rotating the blade 31 clockwise and counterclockwise to a small extent. The sum Et of the integral value of the rotation torque, which is obtained when the blade 31 is caused to enter from the position distant from the bottom surface of the toner powder layer by 80 mm up to the position distant therefrom by 20 mm, over the moving distance of the blade and the integral value of the vertical load over the moving distance is defined as the E.

<Mechanism Via which Effect is Expressed>

The inventors of the present disclosure have conceived the mechanism via which the process cartridge having the above-mentioned configuration is effective in reducing the torque of the electrophotographic photosensitive member and suppressing a cleaning failure to be as described below.

The presence of the mountain range-like wrinkles is assumed to reduce an area of contact between the electrophotographic photosensitive member and the cleaning blade at the time of the abutment of the cleaning blade to reduce a frictional force therebetween. The ridge lines of the mountain range-like wrinkles are directed toward various directions, and hence an image detrimental effect, such as a streak, due to a situation in which the toner converges on one site to escape from the blade, the situation occurring in groove shape processing, does not occur. However, when low-fluidity toner is used, the toner receives various forces from the inclined surfaces of the mountain range-like wrinkles, and hence the toner moves so as to circulate in front of a deposited layer. Thus, the fine toner or its external additive leaks from an opening in the blade. As a result, a charging member is contaminated, though no image detrimental effect occurs. In view of the foregoing, when the toner is combined with high-fluidity toner, the flow of the toner in front of the blocking layer can be suppressed, and hence the escape of the toner is suppressed without occurrence of the breakage of the blocking layer. Thus, no cleaning failure occurs. Although the use of the low-fluidity toner generally increases the torque of the electrophotographic photosensitive member, an increase in torque thereof in a cleaning step can be suppressed by the wrinkle shapes on the surface of the electrophotographic photosensitive member, and hence both of the reduction in torque and the suppression of a cleaning failure can be achieved at high levels.

As described in the foregoing mechanism, when the respective configurations of the photosensitive member and the toner synergistically affect each other in the process cartridge according to one aspect of the present disclosure, an effect according to the present disclosure can be achieved.

The configuration of the electrophotographic photosensitive member according to one aspect of the present disclosure is described in detail below.

[Electrophotographic Photosensitive Member]

The electrophotographic photosensitive member includes a support, a photosensitive layer arranged on the support, and a surface layer containing a curable resin. A method of producing the electrophotographic photosensitive member is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

The support and the respective layers are described below.

<Support>

In the present disclosure, the electrophotographic photosensitive member includes the support and the surface layer. In the present disclosure, the support is preferably an electroconductive support having electroconductivity. In addition, examples of the shape of the support include a cylindrical shape, a belt shape, and a sheet shape. A support having a cylindrical shape out of those shapes is preferred. In addition, the surface of the support may be subjected to, for example, electrochemical treatment, such as anodization, blast treatment, or cutting treatment.

A metal, a resin, glass, or the like is preferred as a material for the support.

Examples of the metal include aluminum, iron, nickel, copper, gold, stainless steel, and alloys thereof. An aluminum support using aluminum out of those metals is preferred.

In addition, electroconductivity may be imparted to the resin or the glass through treatment involving, for example, mixing or coating the resin or the glass with an electroconductive material.

<Electroconductive Layer>

In the present disclosure, an electroconductive layer may be arranged on the support. The arrangement of the electroconductive layer can conceal a flaw and unevenness on the surface of the support, and can control the reflection of light on the surface of the support.

The electroconductive layer preferably contains electroconductive particles and a resin.

A material for the electroconductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, the metal oxide is preferably used as the electroconductive particles. In particular, titanium oxide, tin oxide, or zinc oxide is more preferably used.

When the metal oxide is used as the electroconductive particles, the surface of the metal oxide may be treated with a silane coupling agent or the like, or the metal oxide may be doped with an element such as phosphorus or aluminum, or an oxide thereof.

In addition, the electroconductive particles may each be of a laminated configuration including a core particle and a covering layer covering the core particle. A material for the core particle is, for example, titanium oxide, barium sulfate, or zinc oxide. A material for the covering layer is, for example, a metal oxide, such as tin oxide.

In addition, when the metal oxide is used as the electroconductive particles, the volume-average particle diameter of the particles is preferably from 1 to 500 nm, more preferably from 3 to 400 nm.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the electroconductive layer may further contain, for example, a concealing agent, such as a silicone oil, resin particles, or titanium oxide.

The average thickness of the electroconductive layer is preferably from 1 to 50 μm, particularly preferably from 3 to 40 μm.

The electroconductive layer may be formed by: preparing a coating liquid for an electroconductive layer containing the above-mentioned respective materials and a solvent; forming a coating film of the coating liquid; and drying the coating film. Examples of the solvent to be used in the coating liquid include an alcohol-based solvent, a sulfoxide-based solvent, a ketone-based solvent, an ether-based solvent, an ester-based solvent, and an aromatic hydrocarbon-based solvent. A dispersion method for the dispersion of the electroconductive particles in the coating liquid for an electroconductive layer is, for example, a method including using a paint shaker, a sand mill, a ball mill, or a liquid collision-type high-speed dispersing machine.

<Undercoat Layer>

In the present disclosure, an undercoat layer may be arranged on the support or the electroconductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin.

Examples of the polymerizable functional group of the monomer having the polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting material, a metal oxide, a metal, an electroconductive polymer, and the like for the purpose of improving electric characteristics. Of those, an electron-transporting material and a metal oxide are preferably used.

Examples of the electron-transporting material include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting material having a polymerizable functional group may be used as the electron-transporting material and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably from 0.1 to 50 μm, more preferably from 0.2 to 40 μm, particularly preferably from 0.3 to 30 μm.

The undercoat layer may be formed by: preparing a coating liquid for an undercoat layer containing the above-mentioned respective materials and a solvent; forming a coating film of the coating liquid; and drying and/or curing the coating film. Examples of the solvent to be used in the coating liquid include an alcohol-based solvent, a ketone-based solvent, an ether-based solvent, an ester-based solvent, and an aromatic hydrocarbon-based solvent.

<Photosensitive Layer>

The photosensitive layer of the electrophotographic photosensitive member is mainly classified into (1) a laminate type photosensitive layer and (2) a monolayer type photosensitive layer. (1) The laminate type photosensitive layer includes a charge generating layer containing a charge generating substance and a charge transporting layer containing a charge transporting substance. (2) The monolayer type photosensitive layer includes a photosensitive layer containing both of the charge generating substance and the charge transporting substance.

(1) Laminate Type Photosensitive Layer

The laminate type photosensitive layer includes the charge generating layer and the charge transporting layer.

(1-1) Charge Generating Layer

The charge generating layer preferably contains the charge generating substance and a resin.

Examples of the charge generating substance include an azo pigment, a perylene pigment, a polycyclic quinone pigment, an indigo pigment, and a phthalocyanine pigment. Of those, an azo pigment and a phthalocyanine pigment are preferred. Of the phthalocyanine pigments, an oxytitanium phthalocyanine pigment, a chlorogallium phthalocyanine pigment, and a hydroxygallium phthalocyanine pigment are preferred.

The content of the charge generating substance in the charge generating layer is preferably from 40 to 85 mass %, more preferably from 60 to 80 mass % with respect to the total mass of the charge generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge generating layer is preferably from 0.1 to 1 μm, more preferably from 0.15 to 0.4 μm.

The charge generating layer may be formed by: preparing a coating liquid for a charge generating layer containing the above-mentioned respective materials and a solvent; forming a coating film of the coating liquid; and drying the coating film. Examples of the solvent to be used in the coating liquid include an alcohol-based solvent, a sulfoxide-based solvent, a ketone-based solvent, an ether-based solvent, an ester-based solvent, and an aromatic hydrocarbon-based solvent.

(1-2) Charge Transporting Layer

The charge transporting layer preferably contains the charge transporting substance and a resin.

Examples of the charge transporting substance include a polycyclic aromatic compound, a heterocyclic compound, a hydrazone compound, a styryl compound, an enamine compound, a benzidine compound, a triarylamine compound, and a resin having a group derived from any of those substances. Of those, a triarylamine compound and a benzidine compound are preferred, and a compound having the following structure is suitably used.

(1)

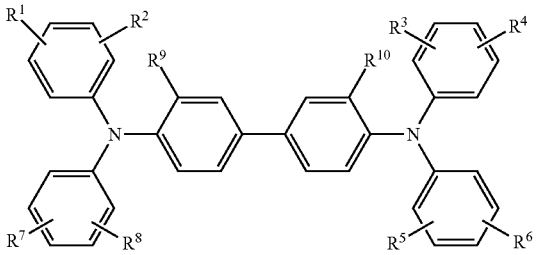

In the formula (1), $R^1$ to $R^{10}$ each independently represent a hydrogen atom or a methyl group.

Examples of the structure represented by the formula (1) are represented in the formulae (1-1) to (1-10). Of those, the structures represented by the formulae (1-1) to (1-6) are more preferred.

(1-1)

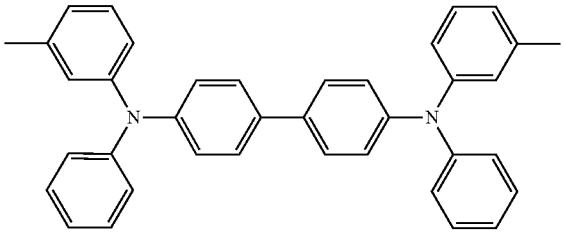

-continued (1-2)

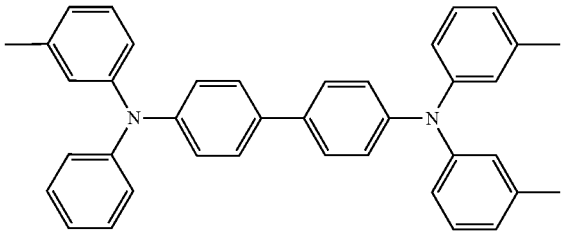

(1-3)

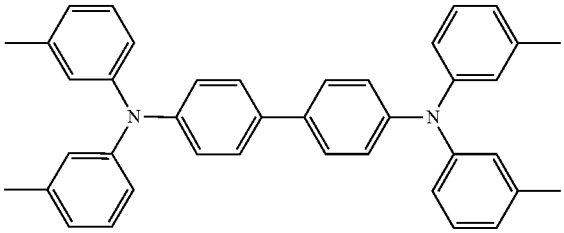

(1-4)

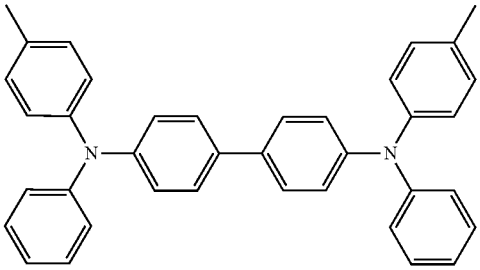

(1-5)

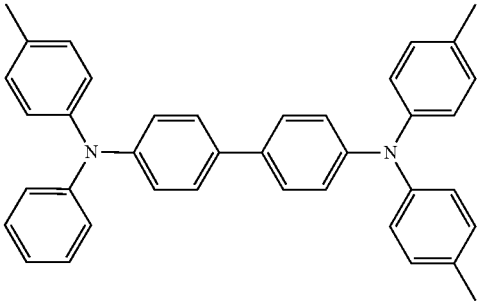

(1-6)

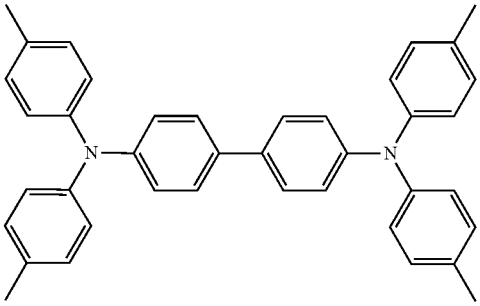

-continued (1-7)

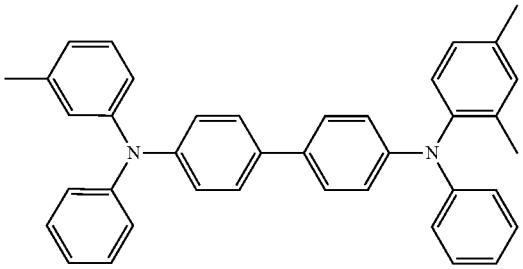

(1-8)

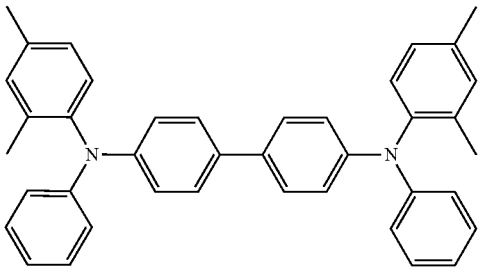

(1-9)

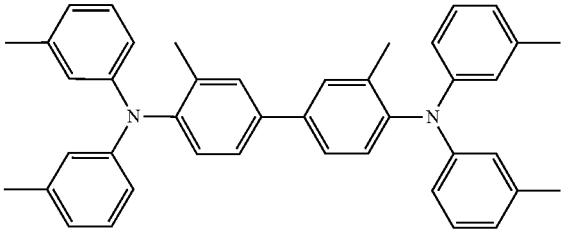

(1-10)

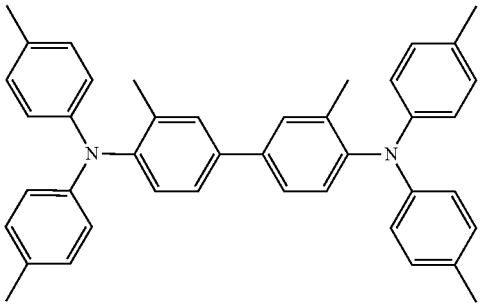

A thermoplastic resin is used as the resin, and examples thereof include a polyester resin, a polycarbonate resin, an acrylic resin, and a polystyrene resin. Of those, a polycarbonate resin and a polyester resin are preferred. A polyarylate resin is particularly preferred as the polyester resin.

The content of the charge transporting substance in the charge transporting layer is preferably from 25 to 70 mass %, more preferably from 30 to 55 mass % with respect to the total mass of the charge transporting layer.

A content ratio (mass ratio) between the charge transporting substance and the resin is preferably from 4:10 to 20:10, more preferably from 5:10 to 12:10.

In addition, the charge transporting layer may contain an additive, such as an antioxidant, a UV absorber, a plasticizer, a leveling agent, a slipperiness-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the charge transporting layer is preferably from 5 to 50 μm, more preferably from 8 to 40 μm, particularly preferably from 10 to 30 μm.

The charge transporting layer may be formed by: preparing a coating liquid for a charge transporting layer containing the above-mentioned respective materials and a solvent; forming a coating film of the coating liquid; and drying the coating film. Examples of the solvent to be used in the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Monolayer Type Photosensitive Layer

The monolayer type photosensitive layer may be formed by: preparing a coating liquid for a photosensitive layer containing the charge generating substance, the charge transporting substance, a resin, and a solvent; forming a coating film of the coating liquid; and drying the coating film. The charge generating substance, the charge transporting substance, and the resin are the same as the examples of the materials in the above-mentioned section "(1) Laminate Type Photosensitive Layer".

<Protection Layer>

In the present disclosure, a protection layer may be arranged on the photosensitive layer. The arrangement of the protection layer can improve the durability of the electrophotographic photosensitive member.

The protection layer preferably contains electroconductive particles and/or the charge transporting substance, and a resin.

Examples of the electroconductive particles include particles of metal oxides, such as titanium oxide, zinc oxide, tin oxide, and indium oxide.

Examples of the charge transporting substance include a polycyclic aromatic compound, a heterocyclic compound, a hydrazone compound, a styryl compound, an enamine compound, a benzidine compound, a triarylamine compound, and a resin having a group derived from any of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred. In addition, the protection layer may be formed as a cured film by polymerizing a composition containing a monomer having a polymerizable functional group. A reaction at that time is, for example, a thermal polymerization reaction, a photopolymerization reaction, or a radiation polymerization reaction. Examples of the polymerizable functional group of the monomer having the polymerizable functional group include an acrylic group and a methacrylic group. A material having a charge transporting ability may be used as the monomer having the polymerizable functional group.

A compound having a polymerizable functional group may have a charge transportable structure as well as a chain-polymerizable functional group. The charge transportable structure is preferably a triarylamine structure in terms of charge transportation. The chain-polymerizable functional group is preferably an acryloyl group or a methacryloyl group. The number of the functional groups may be one, or two or more. A case in which the cured film is formed by incorporating a compound having a plurality of functional groups and a compound having one functional group out of such compounds is particularly preferred because distortion caused by the polymerization of the plurality of functional groups is easily eliminated.

Examples of the compound having one functional group are represented in (2-1) to (2-6).
(2-1)
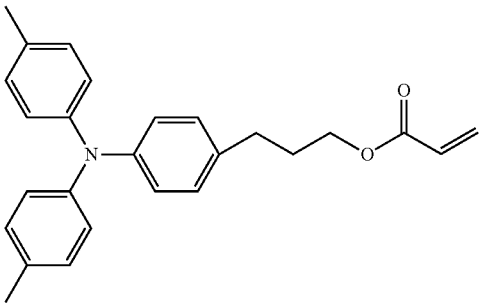
(2-2)
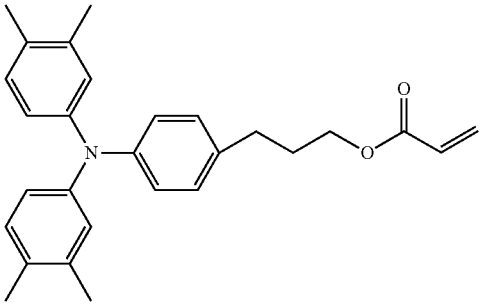
(2-3)
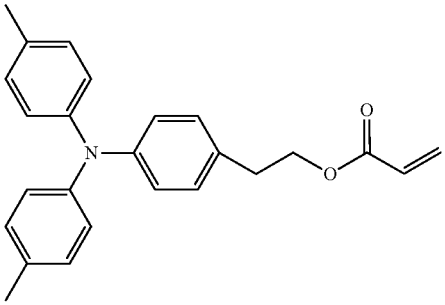
-continued
(2-4)
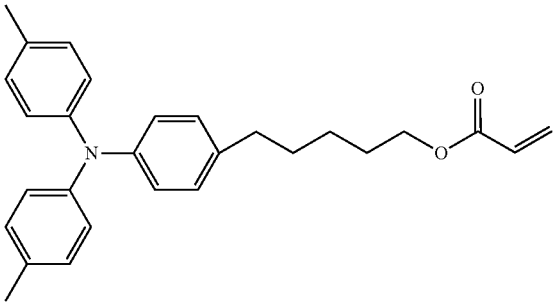
(2-5)
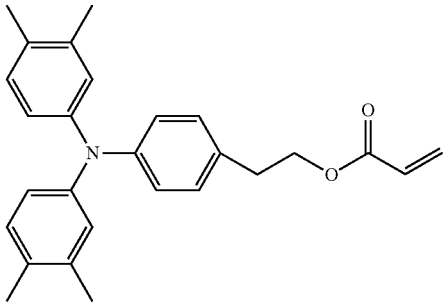
(2-6)
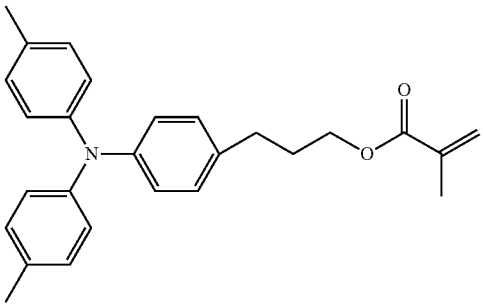
Examples of the compound having a plurality of functional groups are represented in (3-1) to (3-7).
(3-1)
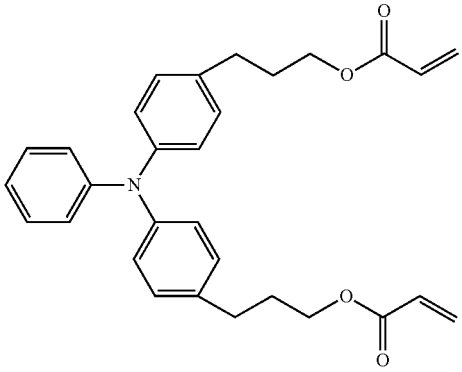
(3-2)
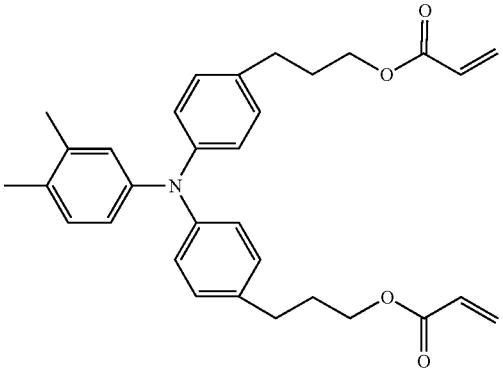

-continued (3-3)

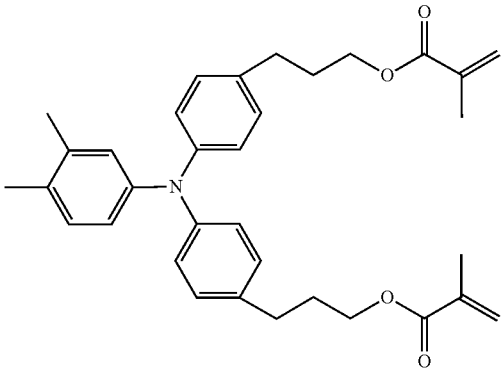

(3-4)

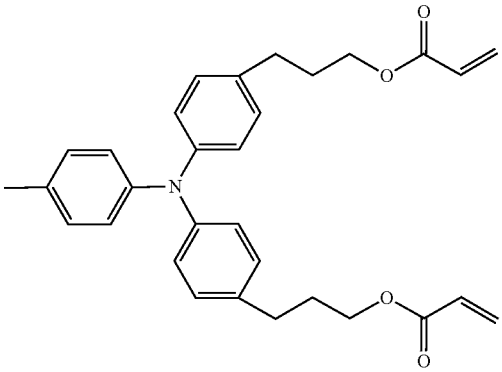

(3-5)

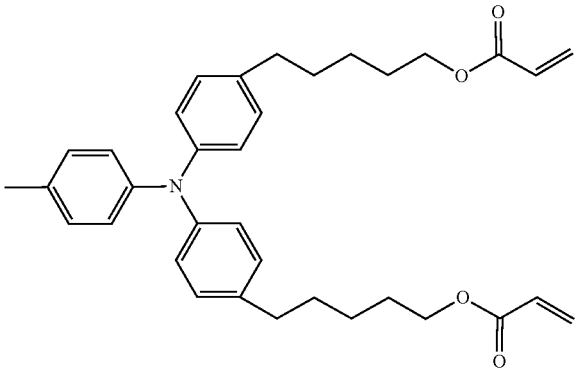

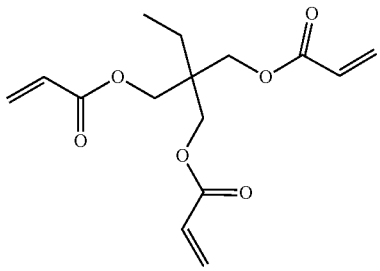

(3-6)

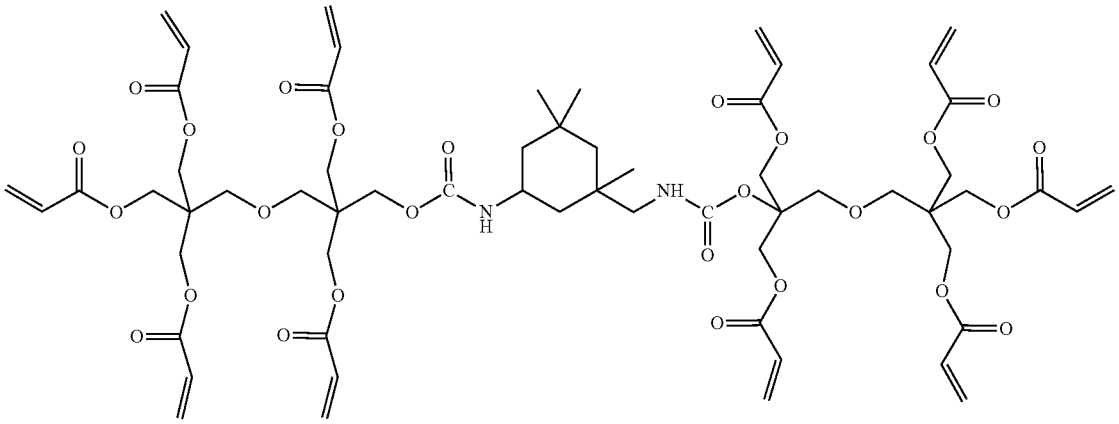

The protection layer may contain an additive, such as an antioxidant, a UV absorber, a plasticizer, a leveling agent, a slipperiness-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The protection layer may be formed by: preparing a coating liquid for a protection layer containing the above-mentioned respective materials and a solvent; forming a coating film of the coating liquid; and drying and/or curing the coating film. Examples of the solvent to be used in the coating liquid include an alcohol-based solvent, a ketone-based solvent, an ether-based solvent, a sulfoxide-based solvent, an ester-based solvent, and an aromatic hydrocarbon-based solvent.

<Method of Forming Unevenness on Surface of Electrophotographic Photosensitive Member>

A method of forming unevenness on the surface of the electrophotographic photosensitive member is classified into (1) a method of forming wrinkle shapes and (2) a method of forming an embossed shape. The wrinkle shapes of (1) are obtained by laminating films different from each other in thermal expansion behavior, and heating and cooling the laminate, and such a pattern as illustrated in FIG. 1A is formed. As disclosed in Japanese Patent Application Laid-Open No. 2015-161786, the method of forming the embossed shape of (2) includes pressing a mold made of a metal or the like against the surface of the electrophotographic photosensitive member to form a pattern, and has been widely known as a technology of imparting a surface shape to the electrophotographic photosensitive member.

(1) Wrinkle Shapes

The method of forming the wrinkle shapes includes: forming the protection layer that is a crosslinkable cured film on the charge transporting layer containing the thermoplastic resin as a main component; and then subjecting the laminate to heating treatment to produce the wrinkle shapes. It is assumed that at that time, a compressive stress is applied in the surface direction of the electrophotographic photosensitive member by a difference in deformation amount between the protection layer and the charge transporting layer to buckle the surface protection layer, and hence the wrinkle shapes are formed.

(2) Embossed Shape

The method of forming the embossed shape includes an uneven shape-transferring step of bringing a mold member having an uneven shape into pressure contact with the electrophotographic photosensitive member to transfer the uneven shape of the mold member onto the surface of the electrophotographic photosensitive member. At this time, although the uneven shape can be formed even on the photosensitive member free of any protection layer, the photosensitive member preferably includes the protection layer in terms of durability.

Figure 4:
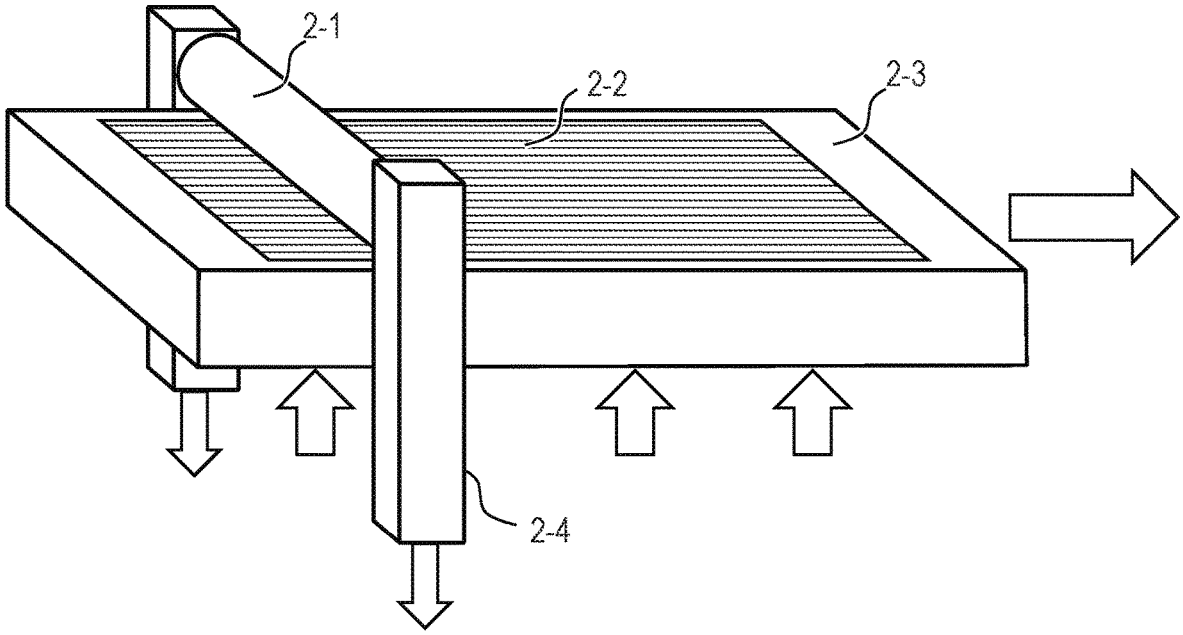
FIG. 4 is a view for illustrating a polishing machine used for polishing the surfaces of electrophotographic photosensitive members in Comparative Examples.

FIG. 4 is an illustration of an example of a pressure pattern transferring apparatus for forming concave portions on the surface of the electrophotographic photosensitive member.

According to the pressure pattern transferring apparatus illustrated in FIG. 4, while an electrophotographic photosensitive member 2-1 serving as a work piece is rotated, a mold member 2-2 is continuously brought into contact with the surface (peripheral surface) of the electrophotographic photosensitive member to pressurize the surface. Thus, the concave portions can be formed on the surface of the electrophotographic photosensitive member 2-1.

A material for a pressurizing member 2-3 is, for example, a metal, a metal oxide, plastic, or glass. Of those, stainless steel (SUS) is preferred from the viewpoints of mechanical strength, dimensional accuracy, and durability. The mold member is arranged on the upper surface of the pressurizing member 2-3. In addition, the mold member 2-2 can be brought into contact with the surface of the electrophotographic photosensitive member 2-1 supported by supporting members 2-4 at a predetermined pressure by a supporting member (not shown) and a pressurizing system (not shown) arranged on the lower surface side of the pressurizing member. In addition, the supporting members 2-4 may be pressed against the pressurizing member 2-3 at a predetermined pressure, or the supporting members 2-4 and the pressurizing member 2-3 may be pressed against each other.

The example illustrated in FIG. 4 is an example in which the pressurizing member 2-3 is moved in a direction vertical to the shaft direction of the electrophotographic photosensitive member 2-1 to continuously process the surface of the electrophotographic photosensitive member 2-1 while causing or driving the electrophotographic photosensitive member to rotate. Further, the surface of the electrophotographic photosensitive member 2-1 may be continuously processed by moving the supporting members 2-4 in the direction vertical to the shaft direction of the electrophotographic photosensitive member 2-1 while fixing the pressurizing member 2-3, or by moving both of the supporting members 2-4 and the pressurizing member 2-3.

The mold member 2-2 and the electrophotographic photosensitive member 2-1 are preferably heated from the viewpoint of efficiently transferring the shape of the mold member.

Examples of the mold member 2-2 include: a metal or a resin film subjected to fine surface processing; a product obtained by pattering the surface of a silicon wafer or the like with a resist; a resin film having dispersed therein fine particles; and a product obtained by coating a resin film having a fine surface shape with a metal.

In addition, an elastic body is preferably arranged between the mold member 2-2 and the pressurizing member 2-3 from the viewpoint of uniformizing the pressure at which the mold member is pressed against the electrophotographic photosensitive member 2-1.

The configuration of the toner according to one aspect of the present disclosure is described in detail below.

[Toner]

A method of producing the toner particles of the present disclosure is not particularly limited as long as the above-mentioned fluidity torque can be achieved, and a known production method may be used.

The toner particles of the present disclosure are preferably toner obtained by a suspension polymerization method in which its toner particles are prepared through the following process out of the known production methods: a radical-polymerizable monomer and a colorant are dispersed; then the droplets of the dispersion liquid are dispersed in an aqueous medium or the like so that desired toner particle diameters may be obtained; and the resultant is subjected to suspension polymerization. This is because particles having a sharp particle size distribution, high sphericities, and surfaces with substantially uniform material quality can be formed, and hence stable fluidity and an excellent charging characteristic are easily obtained.

The method of producing the toner particles to be used in the present disclosure is described below by taking the suspension polymerization method that is most suitable in obtaining the toner particles as an example.

The polymerizable monomer, the colorant, a polar resin, a releasing agent, and any other additive to be used as required are uniformly dissolved or dispersed with a dispersing machine, such as a homogenizer, a ball mill, a colloid mill, or an ultrasonic wave dispersing machine, and a polymerization initiator is dissolved in the resultant to prepare a polymerizable monomer composition.

Next, the polymerizable monomer composition is dispersed in an aqueous medium containing a dispersion stabilizer and granulated to form particles, and the polymerizable monomer in the particles is polymerized to produce the toner particles.

The polymerization initiator may be added simultaneously with the addition of the other additive to the polymerizable monomer, or may be mixed immediately before the dispersion of the polymerizable monomer composition in the aqueous medium.

In addition, the polymerizable monomer or the polymerization initiator dissolved in a solvent may be added immediately after the granulation and before the start of the polymerization reaction.

In the present disclosure, an appropriate acid is preferably added at the time of the dispersion, at the time of the granulation, or before the start of the polymerization reaction for pH adjustment.

An acid that has been generally used, such as hydrochloric acid, sulfuric acid, or nitric acid, may be used as the acid to be used in the toner of the present disclosure.

When the pH of an aqueous solution at the time of the polymerization is adjusted to an appropriate one, toner having more uniform charging performance can be obtained.

When the polar resin is added at the time of the polymerization reaction starting from the step of dispersing the polymerizable monomer composition and ending on the polymerizing step, the state of presence of the polar resin can be controlled in accordance with a balance between polarity exhibited by the polymerizable monomer composition serving as the toner particles and polarity exhibited by the aqueous dispersion medium.

That is, the addition of the polar resin enables function separation in accordance with a resin layer. In addition, the toner particles obtained by the suspension polymerization method are preferred because the particles each have a core-shell structure having encapsulated therein the releasing agent component.

Examples of the polar resin include a polyester resin, an epoxy resin, a styrene-acrylic acid copolymer, a styrene-methacrylic acid copolymer, and a styrene-maleic acid copolymer.

Examples of the polymerizable monomer for forming a binder resin to be used in the toner of the present disclosure include a styrene-acrylic copolymer, a styrene-methacrylic copolymer, an epoxy resin, and a styrene-butadiene copolymer, which have been generally used.

A vinyl-based polymerizable monomer, which is radical-polymerizable, may be used as the polymerizable monomer for forming the binder resin. A monofunctional polymerizable monomer or a polyfunctional polymerizable monomer may be used as the vinyl-based polymerizable monomer.

Examples of the polymerizable monomer for forming the binder resin include: styrene; styrene-based monomers, such as o-(m-, p-)methylstyrene and m-(p-)ethylstyrene; acrylic acid ester-based monomers or methacrylic acid ester-based monomers, such as methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate, and diethylaminoethyl methacrylate; and ene-based monomers, such as butadiene, isoprene, cyclohexene, acrylonitrile, methacrylonitrile, acrylamide, and methacrylamide.

In the present disclosure, a crosslinking agent may be used at the time of the synthesis of the binder resin for improving the mechanical strength of each of the toner particles and for controlling the molecular weight of the THF-soluble component of the toner.

Examples of a difunctional crosslinking agent include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, a polyester type diacrylate (MANDA Nippon Kayaku Co., Ltd.), and products obtained by changing the above-mentioned diacrylates to dimethacrylates.

Examples of a polyfunctional crosslinking agent include pentaerythritol triacrylate, trimethylolethane triacrylate, trimethylolpropane triacrylate, tetramethylolmethane tetraacrylate, oligoester acrylates and methacrylates, 2,2-bis(4-methacryloxypolyethoxyphenyl)propane, diallyl phthalate, triallyl cyanurate, triallyl isocyanurate, and triallyl trimellitate.

Examples of the releasing agent to be used in the present disclosure include: petroleum-based waxes and derivatives thereof, such as a paraffin wax, a microcrystalline wax, and petrolatum; montan waxes and derivatives thereof; hydrocarbon waxes and derivatives thereof obtained by a Fischer-Tropsch method; polyolefin waxes and derivatives thereof, such as a polyethylene wax and a polypropylene wax; natural waxes and derivatives thereof, such as a carnauba wax and a candelilla wax; higher aliphatic alcohols; fatty acids, such as stearic acid and palmitic acid; acid amide waxes; ester waxes; hydrogenated castor oil and derivatives thereof; vegetable waxes; and animal waxes. Of those, a paraffin wax, an ester wax, and a hydrocarbon wax are particularly preferred from the viewpoint of being excellent in releasability.

Examples of the polymerization initiator to be used in the toner of the present disclosure include: azo-based or diazo-based polymerization initiators, such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators, such as benzoyl peroxide, methyl ethyl ketone peroxide, diisopropyl peroxycarbonate, cumene hydroperoxide, 2,4-dichlorobenzoyl peroxide, lauroyl peroxide, and tert-butyl peroxypivalate. Those polymerization initiators may be used alone or as a mixture thereof with reference to a 10-hour half-life temperature, though the kind of the polymerization initiator slightly varies depending on a polymerization method.

The toner of the present disclosure contains a colorant as an essential component for imparting coloring power. Examples of the colorant to be preferably used in the present disclosure include the following organic pigments, organic dyes, and inorganic pigments.

Examples of the organic pigment or organic dye that serves as a cyan-based colorant include a copper phthalocyanine compound and derivatives thereof, an anthraquinone compound, and a base dye lake compound.

Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of the organic pigment or organic dye that serves as a magenta-based colorant include a condensed azo compound, a diketopyrrolopyrrole compound, anthraquinone, a quinacridone compound, a base dye lake compound, a naphthol compound, a benzimidazolone compound, a thioindigo compound, and a perylene compound.

Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Examples of the organic pigment or organic dye that serves as a yellow-based colorant include compounds typified by a condensed azo compound, an isoindolinone compound, an anthraquinone compound, an azo metal complex, a methine compound, and an allyl amide compound.

Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

A black colorant is, for example, a colorant toned to a black color with carbon black, the yellow-based colorant, the magenta-based colorant, or the cyan-based colorant.

Those colorants may be used alone or as a mixture thereof, and may each be used under the state of a solid solution. The colorant to be used in the toner of the present disclosure is selected in terms of a hue angle, chroma, brightness, light fastness, OHP transparency, and dispersibility in the toner.

In the present disclosure, when the toner particles are obtained by using a polymerization method, attention needs to be paid to the polymerization-inhibiting property and aqueous phase-migrating property of the colorant, and hence the colorant is preferably subjected to hydrophobic treatment with a substance that does not inhibit any polymerization.

Known inorganic and organic dispersion stabilizers may each be used as the dispersion stabilizer to be used at the time of the preparation of the aqueous medium.

Specific examples of the inorganic dispersion stabilizer include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina.

In addition, examples of the organic dispersion stabilizer include polyvinyl alcohol, gelatin, methyl cellulose, methylhydroxypropyl cellulose, ethyl cellulose, a sodium salt of carboxymethyl cellulose, and starch.

In addition, a commercial nonionic, anionic, or cationic surfactant may be utilized. Examples of such surfactant include sodium dodecyl sulfate, sodium tetradecyl sulfate, sodium pentadecyl sulfate, sodium octyl sulfate, sodium oleate, sodium laurate, potassium stearate, and calcium oleate.

An inorganic and hardly water-soluble dispersion stabilizer is preferred as the dispersion stabilizer to be used at the time of the preparation of the aqueous medium to be used in the toner of the present disclosure, and a hardly water-soluble inorganic dispersion stabilizer that is soluble in an acid is more preferably used.

In the present disclosure, when the aqueous medium having dispersed therein such dispersion stabilizer as described above is prepared, a commercial dispersion stabilizer may be used and dispersed as it is.

In addition, to obtain the particles of the dispersion stabilizer having fine and uniform particle sizes, the aqueous medium may be prepared by producing the dispersion stabilizer in a liquid medium, such as water, under high-speed stirring.

For example, when tricalcium phosphate is used as the dispersion stabilizer, a preferred dispersion stabilizer may be obtained by mixing an aqueous solution of sodium phosphate and an aqueous solution of calcium chloride under high-speed stirring to form the fine particles of tricalcium phosphate.

In the toner of the present disclosure, a charge control agent may be used as required by being mixed with the toner particles. The blending of the charge control agent can improve and stabilize the charging characteristics of the toner particles, and control the optimum triboelectric charge quantities thereof in accordance with a developing system.

A known charge control agent may be utilized as the charge control agent, and a charge control agent that has a fast charging speed and can stably maintain a constant charge quantity is particularly preferred.

Further, when the toner particles are produced by a direct polymerization method, a charge control agent having a low polymerization-inhibiting property and containing a small amount of matter solubilized in the aqueous medium is particularly preferred.

Examples of a charge control agent that controls the toner so that the toner may be negatively chargeable include the following agents. An organometallic compound and a chelate compound are effective, and examples thereof include: a monoazo metal compound; an acetylacetone metal compound; and an aromatic oxycarboxylic acid-, aromatic dicarboxylic acid-, oxycarboxylic acid-, and dicarboxylic acid-based metal compounds. In addition, the examples of the agent include an aromatic oxycarboxylic acid, aromatic monocarboxylic and polycarboxylic acids, and metal salts, anhydrides, and esters thereof, and phenol derivatives, such as a bisphenol. Further, the examples include a urea derivative, a metal-containing salicylic acid-based compound, a metal-containing naphthoic acid-based compound, a boron compound, a quaternary ammonium salt, a calixarene, and a resin-based charge control agent.

Of those, a polymer having a sulfonic acid-based functional group, the polymer serving as the charge control agent, is preferably a polymer or copolymer having a sulfonic acid group, a sulfonate group, or a sulfonic acid ester group.

A method of controlling the value of the E in the present disclosure is, for example, a method of controlling the value by changing the kind, addition amount, and addition conditions of inorganic fine particles to be added to the toner particles.

[Process Cartridge and Electrophotographic Apparatus]

A process cartridge according to the present disclosure is characterized in that the process cartridge integrally supports the electrophotographic photosensitive member described above, and at least one unit selected from the group consisting of a charging unit, a developing unit, a transferring unit, and a cleaning unit, and is removably mounted onto a main body of an electrophotographic apparatus.

In addition, an electrophotographic apparatus according to the present disclosure is characterized by including the electrophotographic photosensitive member described above, a charging unit, an exposing unit, a developing unit, and a transferring unit.

Figure 2:
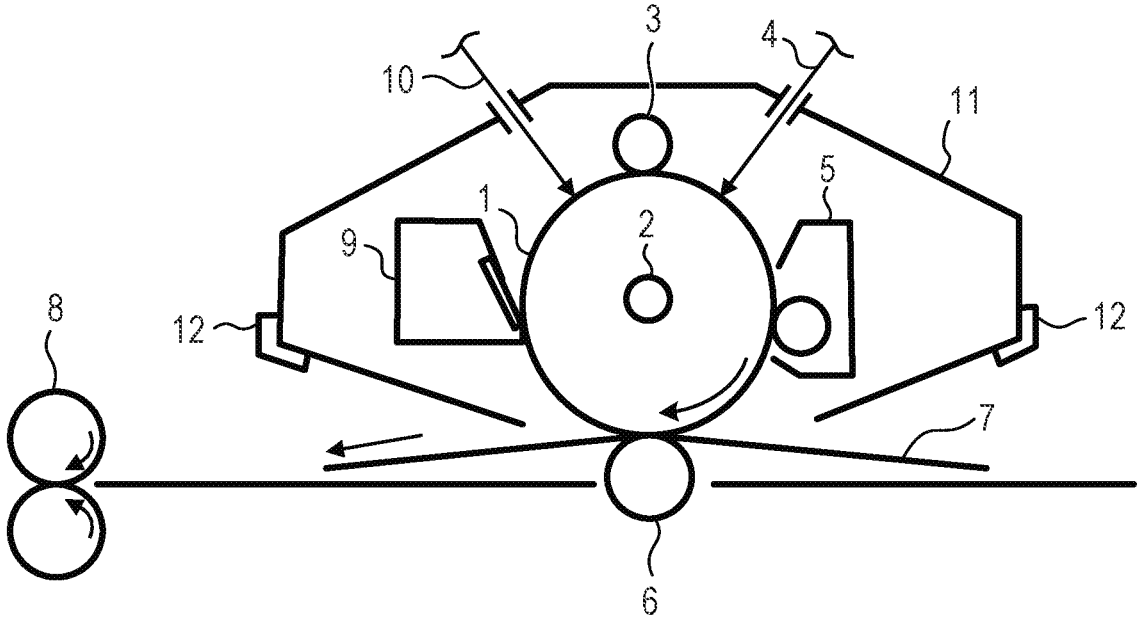
FIG. 2 is a view for illustrating the schematic configuration of an electrophotographic apparatus including a process cartridge including an electrophotographic photosensitive member.

An example of the schematic construction of an electrophotographic apparatus including a process cartridge including an electrophotographic photosensitive member is illustrated in FIG. 2.

An electrophotographic photosensitive member 1 having a cylindrical shape is rotationally driven about a shaft 2 in an arrow direction at a predetermined peripheral speed. The surface of the electrophotographic photosensitive member 1 is charged to a predetermined positive or negative potential by a charging unit 3. Although a roller charging system based on a roller type charging member is illustrated in FIG. 2, a charging system such as a corona charging system, a proximity charging system, or an injection charging system may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system for removing the deposit with the developing unit 5 or the like without separate arrangement of the cleaning unit 9 may be used. The electrophotographic apparatus may include an electricity-removing mechanism for subjecting the surface of the electrophotographic photosensitive member 1 to electricity-removing treatment with pre-exposure light 10 from a pre-exposing unit (not shown). In addition, a guiding unit 12, such as a rail, may be arranged for removably mounting a process cartridge 11 according to the present disclosure onto the main body of an electrophotographic apparatus.

The electrophotographic photosensitive member may be used in, for example, a laser beam printer, an LED printer, and a copying machine.

According to the present disclosure, the process cartridge that achieves both of a reduction in torque and a cleaning property can be provided.

EXAMPLES

The present disclosure is described in more detail below by way of Examples and Comparative Example. The present disclosure is by no means limited to the following Examples, and various modifications may be made without departing from the gist of the present disclosure. In the description in the following Examples, "part(s)" is by mass unless otherwise specified.

<Production of Electrophotographic Photosensitive Member Having Drum Shape (Photosensitive Drum)>

[Method of Producing Photosensitive Drum 1]

An aluminum cylinder (JIS-A3003, aluminum alloy) having a diameter of 24 mm and a length of 257.5 mm was used as a support (electroconductive support).

[Electroconductive Layer]

Next, the following materials were prepared.

Titanium oxide ($TiO_2$) particles coated with oxygen-deficient tin oxide ($SnO_2$), the particles serving as metal oxide particles (average primary particle diameter: 230 nm) 214 parts Phenol resin (monomer/oligomer of a phenol resin) (product name: PLYOPHEN J-325, manufactured by DIC Corporation, resin solid content: 60 mass %) serving as a binding material 132 parts 1-Methoxy-2-propanol serving as a solvent 98 parts Those materials were loaded into a sand mill using 450 parts of glass beads each having a diameter of 0.8 mm, and were subjected to dispersion treatment under the conditions of a number of revolutions of 2,000 rpm, a dispersion treatment time of 4.5 hours, and a set temperature of cooling water of 18° C. to provide a dispersion liquid. The glass beads were removed from the dispersion liquid with a mesh (aperture: 150 μm). Silicone resin particles (product name TOSPEARL 120, manufactured by Momentive Performance Materials Inc., average particle diameter: 2 μm) serving as a surface roughness-imparting material were added to the resultant dispersion liquid. The addition amount of the silicone resin particles was set to 10 mass % with respect to the total mass of the metal oxide particles and the binding material in the dispersion liquid after the removal of the glass beads. In addition, a silicone oil (product name: SH28PA, manufactured by Dow Corning Toray Co., Ltd.) serving as a leveling agent was added to the dispersion liquid so that its addition amount became 0.01 mass % with respect to the total mass of the metal oxide particles and the binding material in the dispersion liquid. Next, a mixed solvent of methanol and 1-methoxy-2-propanol (mass ratio: 1:1) was added to the dispersion liquid so that the total mass of the metal oxide particles, the binding material, and the surface roughness-imparting material (i.e., the mass of a solid content) in the dispersion liquid became 67 mass % with respect to the mass of the dispersion liquid. After that, the mixture was stirred to prepare a coating liquid for an electroconductive layer. The coating liquid for an electroconductive layer was applied onto the support by dip coating, and was heated at 140° C. for 1 hour to form an electroconductive layer having a thickness of 30 μm.

[Undercoat Layer]

Next, the following materials were prepared.

| | |
|---|---|
| Electron transporting substance (formula E-1) | 4 parts |
| Blocked isocyanate (product name: DURANATE SBN-70D, manufactured by Asahi Kasei Chemicals Corporation) | 5.5 parts |
| Polyvinyl butyral resin (S-LEC KS-5Z, manufactured by Sekisui Chemical Co., Ltd.) | 0.3 part |
| Zinc(II) hexanoate serving as a catalyst (manufactured by Mitsuwa Chemicals Co., Ltd.) | 0.05 part |

Those materials were dissolved in a mixed solvent of 50 parts of tetrahydrofuran and 50 parts of 1-methoxy-2-propanol to prepare a coating liquid for an undercoat layer. The coating liquid for an undercoat layer was applied onto the electroconductive layer by dip coating, and was heated at 170° C. for 30 minutes to form an undercoat layer having a thickness of 0.7 μm.

(E-1)

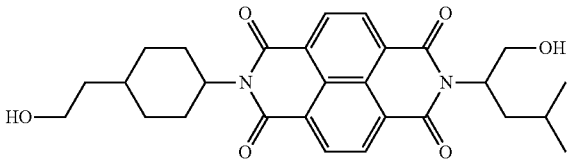

[Charge Generating Layer]

Next, 10 parts of hydroxygallium phthalocyanine of a crystal form having peaks at positions of 7.5° and 28.4° in a chart obtained by its CuKα characteristic X-ray diffraction and 5 parts of a polyvinyl butyral resin (product name: S-LEC BX-1, manufactured by Sekisui Chemical Co., Ltd.) were prepared. Those materials were added to 200 parts of cyclohexanone, and were dispersed therein with a sand mill apparatus using glass beads each having a diameter of 0.9 mm for 6 hours. 150 Parts of cyclohexanone and 350 parts of ethyl acetate were further added to the dispersion liquid to dilute the dispersion liquid. Thus, a coating liquid for a charge generating layer was obtained. The resultant coating liquid was applied onto the undercoat layer by dip coating, and was dried at 95° C. for 10 minutes to form a charge generating layer having a thickness of 0.20 μm.

The measurement of X-ray diffraction was performed under the following conditions.

[Powder X-Ray Diffraction Measurement]

Measurement apparatus used: X-ray diffraction apparatus RINT-TTRII, manufactured by Rigaku Corporation X-ray tube bulb: Cu Tube voltage: 50 KV Tube current: 300 mA Scan method: 2θ/θ scan Scan speed: 4.0°/min Sampling interval: 0.02°

Start angle (2θ): 5.0°

Stop angle (2θ): 40.0°

Attachment: standard sample holder

Filter: not used

Incident monochrome: used

Counter monochrometer: not used

Divergent slit: open

Divergent longitudinal restriction slit: 10.00 mm

Scattering slit: open

Light receiving slit: open

Flat sheet monochrometer: used

Counter: scintillation counter

[Charge Transporting Layer]

Next, the following materials were prepared.

| | |
|---|---|
| Charge transporting substance (hole transportable substance) represented by the structural formula (1-1) | 5 parts |
| Charge transporting substance (hole transportable substance) represented by the structural formula (1-3) | 5 parts |
| Polycarbonate (product name: IUPILON Z400, manufactured by Mitsubishi Engineering-Plastics Corporation) | 10 parts |
| Polycarbonate resin having copolymerization units represented by the following structural formula (C-4) and the following structural formula (C-5) (x/y = 0.95/0.05: viscosity − average molecular weight = 20,000) | 0.02 part |

Those materials were dissolved in a mixed solvent of 60 parts of toluene, 2.3 parts of methyl benzoate, and 12.8 parts of tetrahydrofuran to prepare a coating liquid for a charge transporting layer. The coating liquid for a charge transporting layer was applied onto the charge generating layer by dip coating to form a coating film, and the coating film was dried at 100° C. for 20 minutes to form a charge transporting layer having a thickness of 16 μm.

(C-4)

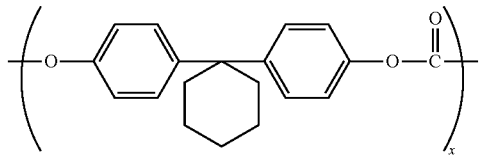

(C-5)

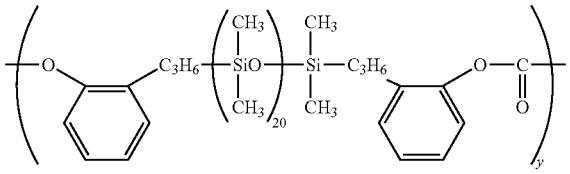

[Protection Layer]

Next, the following materials were prepared.

| | |
|---|---|
| Compound represented by the structural formula (2-1) | 8 parts |
| Compound represented by the structural formula (3-1) | 16 parts |
| Siloxane-modified acrylic compound (SYMAC US270, manufactured by Toagosei Co., Ltd.) | 0.1 part |

Those materials were mixed into 58 parts of cyclohexane and 25 parts of 1-propanol, and the mixture was stirred. Thus, a coating liquid for a protection layer was prepared.

The coating liquid for a protection layer was applied onto the charge transporting layer by dip coating to form a coating film, and the resultant coating film was dried at 40° C. for 5 minutes. After that, under a nitrogen atmosphere, the coating film was irradiated with electron beams for 1.6 seconds under the conditions of an acceleration voltage of 70 kV and a beam current of 5.0 mA while the support (irradiation target body) was rotated at a speed of 300 rpm. The dose of the electron beams at a position on the outermost surface layer of the support was 15 kGy. After that, under the nitrogen atmosphere, first heating was performed by increasing the temperature of the coating film from 25° C. to 100° C. over 20 seconds. Thus, a protection layer having a thickness of 1.5 μm was formed. An oxygen concentration during a period from the electron beam irradiation to the subsequent heating treatment was 10 ppm or less. Next, in the air, the coating film was naturally cooled until its temperature became 25° C., and second heating treatment was performed for 15 minutes under such a condition that the temperature of the coating film became 220° C., thereby forming wrinkle shapes. Thus, a photosensitive drum 1 of Example 1 that was an electrophotographic photosensitive member including the protection layer and having a drum shape (cylindrical shape) was produced.

[Method of Producing Photosensitive Drum 2]

A photosensitive drum 2 was produced in the same manner as in the photosensitive drum 1 except that the thickness of the protection layer was set to 0.5 μm.

[Method of Producing Photosensitive Drum 3]

A photosensitive drum 3 was produced in the same manner as in the photosensitive drum 1 except that the thickness of the protection layer was set to 0.3 μm.

[Method of Producing Photosensitive Drum 4]

A photosensitive drum 4 was produced in the same manner as in the photosensitive drum 1 except that after the drying of the charge transporting layer, the layer was rubbed with nonwoven fabric in its peripheral direction, and then the protection layer was applied thereto.

With regard to a method for the rubbing treatment, TORAYSEE MK SHEET (manufactured by Toray Industries, Inc.) was used as the nonwoven fabric for rubbing. The nonwoven fabric was brought into a tense state so as not to twist, and was brought into contact with the surface of the support that had passed through the process up to the formation of the charge transporting layer. The fabric was squeezed into the surface from the very contact position by 3 mm, and the support was rotated at 60 rpm for 1 second to rub the layer in the peripheral direction.

[Method of Producing Photosensitive Drum 5]

A photosensitive drum 5 was produced in the same manner as in the photosensitive drum 4 except that the thickness of the protection layer was set to 0.5 μm.

[Method of Producing Photosensitive Drum 6]

A photosensitive drum 6 was produced in the same manner as in the photosensitive drum 4 except that the thickness of the protection layer was set to 0.3 μm.

[Method of Producing Photosensitive Drum 7]

A photosensitive drum 7 was produced in the same manner as in the photosensitive drum 1 except that after the drying of the charge transporting layer, the layer was rubbed with nonwoven fabric in its longitudinal direction, and then the protection layer was applied thereto.

With regard to a method for the rubbing treatment, TORAYSEE MK SHEET (manufactured by Toray Industries, Inc.) was used as the nonwoven fabric for rubbing. The nonwoven fabric was brought into a tense state so as not to twist, and was brought into contact with the surface of the support that had passed through the process up to the formation of the charge transporting layer. The fabric was squeezed into the surface from the very contact position by 3 mm, and the layer was rubbed in the longitudinal direction.

[Method of Producing Photosensitive Drum 8]

A photosensitive drum 8 was produced in the same manner as in the photosensitive drum 7 except that the thickness of the protection layer was set to 0.5 μm.

[Method of Producing Photosensitive Drum 9]

A photosensitive drum 9 was produced in the same manner as in the photosensitive drum 7 except that the thickness of the protection layer was set to 0.3 μm.

[Method of Producing Photosensitive Drum 10]

A photosensitive drum 10 was produced in the same manner as in the photosensitive drum 1 except that in the drying step after the application of the protection layer, the second heating was not performed, and hence the drum was produced without formation of wrinkle shapes.

[Method of Producing Photosensitive Drum 11]

A photosensitive drum produced without performance of the second heating of the photosensitive drum of Example 1 was prepared. The surface of the photosensitive drum was polished with a polishing machine illustrated in FIG. 4 under the following conditions.

Feeding speed of a polishing sheet: 400 mm/min
Number of revolutions of the photosensitive drum: 240 rpm
Polishing grains: Silicon carbide
Average particle diameter of the polishing grains: 3 μm
Polishing time: 20 seconds A method for the polishing was as described below. While a polishing sheet obtained by arranging, on a sheet-shaped substrate, a layer obtained by dispersing the polishing grains in a binder resin was fed in an arrow direction, a photosensitive drum (electrophotographic photosensitive member having a drum shape) was subjected to surface roughening treatment by being pressed for 20 seconds while being rotated in an arrow direction.

<Evaluations of Photosensitive Drums>

The following evaluations were performed on the photosensitive drums 1 to 5.

[Surface Shape Observation and Analysis 1]

The average Lave of distances between the ridge lines of convex portions adjacent to each other, the convex portions each having a ridge line portion in which the θ fell within the range between 45° and 135°, and the average have of the heights of the convex portions having the ridge line portions were determined for the surface of each of the photosensitive drums by the above-mentioned methods. The evaluation results are shown in Table 1.

[Surface Shape Observation and Analysis 2]

The surface shape of the surface of each of the photosensitive drums was observed with a laser microscope (VK-X200 manufactured by Keyence Corporation) in an enlarged manner, and whether or not the photosensitive drum had wrinkles over the entirety of the surface was recognized. Further, whether or not an observation region included one or more ridge line portions of the wrinkles in each of which the θ fell within the range between 45° and 135°, and whether or not observation points at each of which the θ fell within the range between 45° and 135° accounted for more than a half of the observation points present in the observation region were recognized by the above-mentioned methods.

All the observation regions were examined for the following condition 1, condition 2, and condition 3, and a case in which all the conditions were satisfied was judged as A, a case in which the conditions 1 and 2 were satisfied was judged as B, a case in which only the condition 1 was satisfied was judged as C, and a case in which none of the conditions was satisfied was judged as D.

Condition 1: The photosensitive drum has mountain range-like wrinkles.

Condition 2: At least one tangential line achieving $45° \leq \theta \leq 135°$ is present.

Condition 3: The number of tangential lines each achieving $45° \leq \theta \leq 135°$ is larger than that of tangential lines each achieving $\theta < 45°$ and that of tangential lines each achieving $135° < \theta$.

The evaluation results are shown in Table 1.

TABLE 1

| | Protection layer thickness/μm | Analysis of surface shape: Evaluation 1 $h_{ave}$/μm | Analysis of surface shape: Evaluation 1 $L_{ave}$/μm | Analysis of surface shape: Evaluation 2 |
|---|---|---|---|---|
| Photosensitive member 1 | 1.5 | 6 | 33 | B |
| Photosensitive member 2 | 0.5 | 2 | 9 | B |
| Photosensitive member 3 | 0.3 | 1.2 | 5 | B |
| Photosensitive member 4 | 1.5 | 6 | 33 | C |
| Photosensitive member 5 | 0.5 | 2 | 9 | C |
| Photosensitive member 6 | 0.3 | 1.2 | 5 | C |
| Photosensitive member 7 | 1.5 | 6 | 33 | A |
| Photosensitive member 8 | 0.5 | 2 | 9 | A |
| Photosensitive member 9 | 0.3 | 1.2 | 5 | A |
| Photosensitive member 10 | 1.5 | — | — | D |
| Photosensitive member 11 | 1.5 | 1 | 5 | D |

<Production Examples of Toners>

Production examples of toners used in Examples and Comparative Examples of the present disclosure are described below.

First, the production examples of the toners used in Examples and Comparative Examples of the present disclosure are described.

Although toner particles produced by a suspension polymerization method were used as the toners used in Examples and Comparative Examples of the present disclosure, the toner particles in the present disclosure are not necessarily limited thereto, and toner particles obtained by a pulverization method, an emulsion polymerization aggregation method, or a dissolution suspension method may also be used.

[Production Example of Toner Particles]

Toner particles 1 were produced by the suspension polymerization method as described below.

The following materials were mixed, and the mixture was stirred for 2 hours so that the polar resin was dissolved. Thus, a polar resin-containing monomer composition was obtained.

| | |
|---|---|
| Styrene | 34.0 parts by mass |
| n-Butyl acrylate | 30.0 parts by mass |
| Polar resin (saturated polyester resin [generated from terephthalic acid and PO-modified bisphenol A: Mp = 9,000, Tg = 72° C., acid value = 12.0 mgKOH/g]) | 5.0 parts by mass |
| Charge control agent BONTRON E-88 (manufactured by Orient Chemical Industries Co., Ltd.) | 1.0 part by mass |

In addition, the following materials were mixed, and the mixture was stirred with an attritor (manufactured by Mitsui Mining Co., Ltd.) together with zirconia beads (3/16 inch) at 200 rpm for 3 hours, followed by the separation of the beads. Thus, a colorant dispersion liquid was obtained.

| | |
|---|---|
| Styrene | 36.0 parts by mass |
| Colorant C.I. Pigment Blue 15:3 | 6.0 parts by mass |
| Polar resin-containing monomer composition | 70.0 parts by mass |
| Colorant dispersion liquid | 42.0 parts by mass |

Next, the above-mentioned materials were mixed. Subsequently, the mixture was warmed to 60° C., and 10.0 parts by mass of a wax (HNP-51 manufactured by Nippon Seiro Co., Ltd.) was added thereto. Next, 5.0 parts by mass of a polymerization initiator PERBUTYL 0 (manufactured by NOF Corporation) was added to the mixture, and the whole was stirred for 5 minutes.

Meanwhile, 875 parts by mass of a 0.1 mol/L aqueous solution of $Na_3PO_4$ and 8.0 parts by mass of 10% hydrochloric acid were added to a container including a high-speed stirring device CLEARMIX (manufactured by M Technique Co., Ltd.). The number of revolutions of the device was adjusted to 15,000 rpm, and the mixture was warmed to 60° C. 70 Parts by mass of a 1.0 mol/L aqueous solution of $CaCl_2$ was added to the mixture to prepare an aqueous medium containing a fine and hardly water-soluble dispersant $Ca_3(PO_4)_2$. After the lapse of 5 minutes from the loading of the above-mentioned polymerization initiator into the polymerizable monomer composition, the polymerizable monomer composition at 60° C. was loaded into the aqueous medium warmed to a temperature of 60° C., and the mixture was granulated for 15 minutes while the CLEARMIX was rotated at 15,000 rpm. After that, the high-speed stirring device was changed to a stirring machine having a propeller stirring blade, and the granulated product was subjected to a reaction at 60° C. for 5 hours while being refluxed. After that, the temperature of the resultant liquid was set to 80° C., and the liquid was further subjected to a reaction for 5 hours. After the completion of the polymerization, the liquid temperature was decreased to about 20° C., and dilute hydrochloric acid was added to set the pH of the aqueous medium to 3.0 or less so that the hardly water-soluble dispersant was dissolved. The solution was further washed and dried to provide toner particles having a weight-average particle diameter (D4) of 5.96 μm.

[Production Example of Silica Fine Particles 1]

Dry silica having a BET specific surface area of 300 $m^2/g$ (average primary particle diameter=8 nm) was loaded into an autoclave with a stirring machine, and under a nitrogen atmosphere, 20 parts of a dimethyl silicone oil (kinematic viscosity: 50 cSt) was added to 100 parts of the dry silica, followed by the holding of the mixture at 250° C. for 30 minutes. After that, the mixture was removed from the autoclave, and was then subjected to shredding treatment to provide silica fine particles 1.

[Production Example of Silica Fine Particles 2]

687.9 Grams of methanol, 42.0 g of pure water, and 47.1 g of 28 mass % ammonia water were loaded into a 3-liter glass reactor including a stirring machine, a dropping funnel, and a temperature gauge, and were mixed. The temperature of the resultant solution was adjusted to 35° C., and 1,100.0 g (7.23 mol) of tetramethoxysilane and 395.2 g of 5.4 mass % ammonia water were simultaneously added thereto while the solution was stirred. Tetramethoxysilane was dropped over 5 hours, and the ammonia water was dropped over 4 hours.

Even after the completion of the dropping, the stirring was further continued for 0.2 hour to perform hydrolysis. Thus, a suspension of hydrophilic and spherical sol-gel silica fine particles was obtained.

After that, the pH of the produced suspension was adjusted to about 3.5. After the adjustment, the reactor was heated to 75° C., and a solution obtained by dissolving 8.8 g of octyltriethoxysilane in 220 ml of isopropyl alcohol was dropped while the suspension in the reactor was stirred. After the dropping, the mixture was continuously stirred for 5 hours.

After the completion of the stirring, the mixture was cooled to room temperature and filtered. The filtrate was washed with ion-exchanged water, and was then dried under heating at 120° C. overnight. After that, the dried product was subjected to shredding treatment with a pulverizer (manufactured by Hosokawa Micron Corporation) to provide target silica fine particles 2.

<Production Example of Toner 1>

0.15 Part by mass of the silica fine particles 1 were added to 100.0 parts by mass of the toner particles, and the materials were mixed with a Henschel mixer (manufactured by Mitsui Mining Co., Ltd.) at 4,000 rpm for 10 minutes to provide a toner 1.

The toner 1 had a fluidity torque E of 346 mJ.

<Production Examples of Toner 2 to Toner 4>

A toner 2 to a toner 4 were each obtained in the same manner as in the production example of the toner 1 except that in the production example of the toner 1, the kind and addition amount of the silica fine particles to be added were changed to those shown in Table 2. The values of the fluidity torques E of the produced toners are also shown in Table 2.

TABLE 2

| | Kind of additive | Addition amount | E/mJ |
|---|---|---|---|
| Toner 1 | Silica fine particles 2 | 0.15 Part | 346 |
| Toner 2 | Silica fine particles 2 | 0.30 Part | 431 |
| Toner 3 | Silica fine particles 2 | 0.10 Part | 318 |
| Toner 4 | Silica fine particles 1 | 0.30 Part | 256 |

Example 1

A reconstructed machine of a laser beam printer available under the product name "HP Color LaserJet CP4525nd" from Hewlett-Packard Company was used as an electrophotographic apparatus. The printer was reconstructed so that the quantity of the drive current of the rotary motor of its photosensitive drum was able to be measured. In addition, the printer was reconstructed so that a voltage to be applied to its charging roller was able to be regulated and measured, and an image exposure light quantity was able to be regulated and measured.

In addition, the cyan cartridge (hereinafter abbreviated as "CRG") of the apparatus was reconstructed, the photosensitive drum was replaced with the photosensitive drum 1, and the toner of the cartridge was replaced with the toner 1. In addition, the pressure at which the cleaning blade of the CRG was brought into abutment with the photosensitive drum was changed to 40% of a product condition.

Examples 2 to 11 and Comparative Examples 1 to 4

Process cartridges of Examples 2 to 11 and Comparative Examples 1 to 4 were each prepared in the same manner as in Example 1 except that in Example 1, the photosensitive drum and the toner were changed as shown in Table 4.

[Evaluation]

Evaluations were performed by using the process cartridges produced in Examples 1 to 11 and Comparative Examples 1 to 4 under the following conditions.

[Evaluation of Relative Value of Torque]

A test chart having a print percentage of 5% was output on 100 sheets of A4 size plain paper. As a charging condition, a dark portion potential was adjusted to −500 V, and as an exposure condition, the image exposure light quantity was adjusted to 0.25 μJ/cm$^2$. A drive current value (current value A) at the time of the output on the 100th sheet was read. A state in which the resultant current value is larger means that a frictional force between the photosensitive drum and the cleaning blade is larger.

The measured value of a process cartridge using the photosensitive drum 10 free of any wrinkle shape on its surface and the toner 3 was defined as a current value B, and was used as the control of a relative value.

The ratio of the drive current value (current value A) of the rotary motor of the photosensitive drum obtained as described above to the drive current value (current value B) was calculated. The resultant numerical values of the ratio "(current value A)/(current value B)" were compared as the relative values of torque. A smaller relative value means that the frictional force between the photosensitive drum and the cleaning blade is reduced to a larger extent. The evaluation results are shown in Table 3.

[Evaluation of Image Streak]

Further, an evaluation was performed by using a halftone image immediately after the output of a horizontal line image in which lines were drawn at intervals of 10 spaces on 1,000 sheets. Specifically, the number of escapes (streaks) occurring in the output image, which were considered to be cleaning failures, was visually counted, and a rank evaluation was performed. The evaluation results are shown in Table 3.

Rank Evaluation Concerning Image Streak

A: No streak in terms of image quality is present, and hence image quality is satisfactory.

B: A slight streak occurs.

C: A streak occurs in part of the image.

D: A streak occurs in the entirety of the image.

[Evaluation of Contamination of Charging Roller]

A tape was applied to the toner deposited on the charging roller used in the evaluation of an image streak, and the concentration of the toner adhering to the tape was measured with a spectral densitometer X-Rite 504 (manufactured by X-Rite Inc.), followed by a rank evaluation based on the value of the reflection density.

A larger numerical value means that the amount of the toner adhering to the charging roller is larger.

Rank evaluation concerning contamination of charging roller

A: Less than 0.1

B: 0.1 or more and less than 0.2

C: 0.2 or more and less than 0.3

D: 0.3 or more

The evaluation results are shown in Table 3.

TABLE 3

| | Photosensitive member No. | Toner No. | Relative torque | Image streak rank | Charging roller contamination rank |
|---|---|---|---|---|---|
| Example 1 | 1 | 1 | 0.66 | B | C |
| Example 2 | 2 | 1 | 0.68 | A | B |
| Example 3 | 3 | 1 | 0.68 | A | A |
| Example 4 | 4 | 1 | 0.65 | B | C |
| Example 5 | 5 | 1 | 0.67 | B | B |
| Example 6 | 6 | 1 | 0.68 | A | B |
| Example 7 | 7 | 1 | 0.68 | A | B |
| Example 8 | 8 | 1 | 0.69 | A | A |
| Example 9 | 9 | 1 | 0.70 | A | A |
| Example 10 | 3 | 2 | 0.70 | A | B |
| Example 11 | 6 | 2 | 0.70 | A | B |
| Example 12 | 9 | 2 | 0.71 | A | A |
| Comparative Example 1 | 10 | 1 | 1.0 | A | A |
| Comparative Example 2 | 11 | 1 | 0.68 | D | B |
| Comparative Example 3 | 9 | 3 | 0.64 | A | D |
| Comparative Example 4 | 9 | 4 | 0.63 | A | D |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-038766, filed Mar. 10, 2021, which is hereby incorporated by reference herein in its entirety.

What is claimed is:

1. A process cartridge comprising:

an electrophotographic photosensitive member having a drum shape;

a developing unit for developing an electrostatic latent image on a surface of the electrophotographic photosensitive member with toner; and a cleaning blade for removing the toner on the surface of the electrophotographic photosensitive member, the cleaning blade being in contact with the electrophotographic photosensitive member, wherein the electrophotographic photosensitive member comprises wrinkles on the surface of the electrophotographic photosensitive member, and wherein the toner has a fluidity torque E of 320 mJ or more.

2. The process cartridge according to claim 1, wherein when a square observation region 50.0 μm on a side is placed at a randomly-selected position on the surface of the electrophotographic photosensitive member, and an angle formed by a tangential line of each of ridge lines of convex portions forming the wrinkles and a line parallel to a peripheral direction of the electrophotographic photosensitive member is represented by θ, the observation region includes one or more ridge line portions of the wrinkles in each of which the θ falls within a range between 45° and 135°.

3. The process cartridge according to claim 2, wherein when observation points are placed on the ridge lines of the convex portions forming the wrinkles in the observation region at intervals of 5.0 μm, the observation points at each of which the θ falls within the range between 45° and 135° account for more than a half of the observation points present in the observation region.

4. The process cartridge according to claim 1, wherein when a sectional profile is obtained for the wrinkles in the peripheral direction of the electrophotographic photosensitive member, the sectional profile is gentle.

5. The process cartridge according to claim 1, wherein when an angle formed by a tangential line of each of ridge lines of convex portions forming the wrinkles and a line parallel to a peripheral direction of the electrophotographic photosensitive member is represented by θ, an average Lave of distances between the ridge lines of the convex portions adjacent to each other, the convex portions each having a ridge line portion in which the θ falls within a range between 45° and 135°, is from 1.0 to 20.0 μm, and an average have of heights of the convex portions having the ridge line portions is from 0.5 to 3.0 μm.

6. The process cartridge according to claim 1, wherein the electrophotographic photosensitive member comprises the wrinkles on an entirety of the surface of the electrophotographic photosensitive member.

7. The process cartridge according to claim 1, wherein the electrophotographic photosensitive member comprises the wrinkles on an entirety of a region where the cleaning blade is in contact with the electrophotographic photosensitive member.

* * * * *